US008763331B2

(12) United States Patent
LeBlang

(10) Patent No.: US 8,763,331 B2
(45) Date of Patent: Jul. 1, 2014

(54) WALL MOLDS FOR CONCRETE STRUCTURE WITH STRUCTURAL INSULATING CORE

(76) Inventor: Dennis LeBlang, Palm Desert, CA (US)

( * ) Notice: Subject to any disclaimer, the term of this patent is extended or adjusted under 35 U.S.C. 154(b) by 57 days.

(21) Appl. No.: 13/437,630

(22) Filed: Apr. 2, 2012

(65) Prior Publication Data

US 2012/0186174 A1 Jul. 26, 2012

Related U.S. Application Data

(63) Continuation-in-part of application No. 12/456,707, filed on Jun. 22, 2009, now Pat. No. 8,161,699, and a continuation-in-part of application No. 12/231,875, filed on Sep. 8, 2008, now Pat. No. 8,176,696.

(51) Int. Cl.

| | |
|---|---|
| ***E04C 1/42*** | (2006.01) |
| ***E04B 2/76*** | (2006.01) |
| ***E04C 3/09*** | (2006.01) |
| ***E04B 1/16*** | (2006.01) |
| *E04B 2/86* | (2006.01) |
| *E04C 3/04* | (2006.01) |

(52) U.S. Cl.

CPC ..... *E04B 1/165* (2013.01); *E04B 2/8617* (2013.01); *E04B 2/763* (2013.01); *E04B 2/8641* (2013.01); *E04C 2003/0473* (2013.01); *E04C 3/09* (2013.01); *E04B 2/8647* (2013.01); *E04B 2/8635* (2013.01)

USPC ..... 52/309.12; 52/252; 52/309.4

(58) Field of Classification Search

USPC ..... 52/252, 309.12, 309.4, 745.09, 667

See application file for complete search history.

(56) References Cited

U.S. PATENT DOCUMENTS

| | | | | |
|---|---|---|---|---|
| 4,338,759 | A | 7/1982 | Swerdlow | |
| 4,357,783 | A | 11/1982 | Shubow | |
| 4,813,193 | A * | 3/1989 | Altizer | 52/210 |
| 5,207,045 | A | 5/1993 | Bodnar | |
| 5,566,518 | A | 10/1996 | Martin | |
| 5,809,724 | A | 9/1998 | Bodnar | |
| 5,809,726 | A | 9/1998 | Spude | |
| 5,839,249 | A | 10/1998 | Roberts | |
| 5,992,114 | A | 11/1999 | Zelinsky | |
| 6,026,620 | A | 2/2000 | Spude | |
| 6,119,432 | A | 9/2000 | Niemann | |
| 6,122,888 | A | 9/2000 | Bodnar | |
| 6,125,608 | A | 10/2000 | Charlson | |
| 6,131,365 | A | 10/2000 | Crockett | |
| 6,134,861 | A | 10/2000 | Spude | |
| 6,164,035 | A | 12/2000 | Roberts | |
| 6,247,280 | B1 | 6/2001 | Grinshpun | |
| 6,250,033 | B1 | 6/2001 | Zelinsky | |
| 6,293,067 | B1 | 9/2001 | Meendering | |
| 6,378,260 | B1 | 4/2002 | Williamson | |

(Continued)

*Primary Examiner* — Jeanette E Chapman
*Assistant Examiner* — Daniel Kenny

(57) ABSTRACT

The present invention relates to wall molds for forming concrete columns and beams using a structural insulating core wall comprising of structural support members with spacer blocks or spacer insulation with inner and outer boards between the support members. The spacer blocks interlock vertically and horizontally between spacer blocks and/or the spacer insulation with its inner and outer boards, between the support channels and connectors, between the trough, horizontal tongue and the horizontal bracing channel all interlocking between each other and the column and beam molds into which concrete is poured into the molds when erected vertically. The beam and column molds use various types of connectors, the structural insulating core, the structural support members within the wall extending above the structural insulating core and the inner and outer boards.

9 Claims, 13 Drawing Sheets

(56) References Cited

U.S. PATENT DOCUMENTS

| | | | | |
|---|---|---|---|---|
| 6,401,417 | B1 | 6/2002 | LeBlang | |
| 6,523,312 | B2 | 2/2003 | Budge | |
| 6,588,168 | B2 | 7/2003 | Walters | |
| 6,609,340 | B2 | 8/2003 | Moore | |
| 6,698,710 | B1 | 3/2004 | VanderWerf | |
| 6,952,905 | B2 | 10/2005 | Nickel | |
| 6,978,581 | B1 | 12/2005 | Spakousky | |
| 7,028,440 | B2 | 4/2006 | Brisson | |
| 7,231,746 | B2 | 6/2007 | Bodnar | |
| 7,415,805 | B2 | 8/2008 | Nickerson | |
| 7,666,258 | B2 * | 2/2010 | Guevara et al. | 106/724 |
| 7,790,302 | B2 * | 9/2010 | Ladely (Guevara) et al. | 428/703 |
| 2007/0199266 | A1 | 8/2007 | Geilen | |
| 2008/0066408 | A1 | 3/2008 | Hileman | |

* cited by examiner

ORIGINAL

WALL MOLDS FOR CONCRETE STRUCTURE WITH STRUCTURAL INSULATING CORE

REFERENCE TO RELATED APPLICATIONS

This application is a continuation-in-part of patent application Ser. No. 12/456,707 filed Jun. 22, 2009 now U.S. Pat. No. 8,161,699 and Ser. No. 12/231,875 filed on Sep. 8, 2008 now U.S. Pat. No. 8,176,696.

FEDERALLY SPONSORED RESEARCH OR DEVELOPMENT

Not Applicable.

PARTIES OR JOINT RESEARCH

Not Applicable.

FIELD OF THE INVENTION

The present invention relates to forming a wall and wall molds with support channels that fit between rigid insulation spacer blocks to form a structural insulating core wall plus inner and outer boards overlap the structural insulating core forming beams and columns molds for concrete to be installed between the structural insulating core or the inner and outer boards may be installed after the structural insulating core is erected vertically. Various wall molds are formed with different supports, connectors and spacer blocks.

BACKGROUND OF THE INVENTION

Today more and more steel or concrete post and beam buildings are being built. Construction techniques for building walls have been changing significantly including metal channel framing and stay-in-place insulated forms where concrete is installed within these forms.

Rigid insulation boards have been installed on metal channels for years. Insulating walls have embedded channels within insulation blocks embedding the metal channels within the rigid insulation. Some insulated concrete forms (ICF's) have embedded plastic connectors within their rigid insulation blocks also separating the rigid foam from the plastic connectors.

There have been various attempts on creating a form mold to pour a concrete column or beam within a wall. Some patents uses metal channels to help reduce the pressure produced by using a rigid foam material to form concrete beam or columns. Another type of patents uses foam blocks with vertical and horizontal chambers to form concrete columns and beams. Another type of panel is a composite panel that uses fiber concrete boards the panel surfaces as well as interior bracing within the panel with rigid foam at the interior. Another type of panel is when the foam molds create a continuous chamber to pour a solid concrete wall.

The creation of a spacer blocks and spacer insulation walls allow various types of horizontal bracing channels and electrical chases or troughs to pass through the wall and concrete columns for additional flexibility and the various connectors to form the walls. In addition the structural insulating wall can be formed with a variety of closed cell rigid insulating materials like polystyrene, cellular light weight concrete or aerated autoclaved concrete all requiring various types of connectors.

DESCRIPTION OF PRIOR ART

A. Foam Block with Holes

In U.S. Pat. No. 7,028,440 (filed Nov. 29, 2003) by Brisson uses foam blocks with vertical holes to form concrete columns and uses a horizontal recess at the top of the panels to form a beam pocket. Since the holes for the concrete only support the foam, the size is limited as the concrete will deform as well as break the foam panels. Again the beam pocket is also fragile as there is not support to stop the wet concrete from deforming the beam.

A. Concrete Column & Beam Using Metal Channels

Panels are formed here using rigid boards and or rigid insulation along with metal channels to form concrete columns or beams. The light gauge framing adds support means for installing drywall or other surface building materials.

In U.S. Pat. No. 6,256,960 by Babcock (filed Apr. 12, 1999) is a modular SIP wall panel with a metal channel at one edge and overlapping inner and outer skins attached to the metal channel. One metal channel and the interior foam wall core form a pocket into which concrete can be poured to form a concrete column. A metal plate covers the top of the SIP panel for connection to a roof structure. The concrete columns are only one channel wide and therefore the column size or structural capacity is very limited.

In U.S. Pat. No. 6,401,417 by LeBlang shows how a concrete column and beam can be installed within a wall using metal channels and rigid insulation/hard board or as a column and beam within a wall and or as a separate beam using a rigid board between the channels to enlarge the beams or columns.

B. Foam Block with Holes.

In U.S. Pat. No. 6,131,365 (filed Oct. 2, 1998) by Crockett has a wall unit system with a "tie down space" is in the middle of the wall for installing steel reinforcing to create a concrete column and a horizontal concrete beam is installed at the top of the wall. The interior concrete column and beam does not show any prior art plus the interior insulated structural material also does not pertain to the pending patent.

In U.S. Pat. No. 4,338,759 by Swerdow (filed Jul. 28, 1980) and U.S. Pat. No. 4,357,783 by Shubow use a plurality of spaced, thin walled tubes are placed between two rows of channels into which concrete is then poured into the walled tubes to make an array of concrete columns within a wall. A beam is installed between the two rows of channels and is support by a metal channel with holes for the columns. The double wall construction is expensive solution to form a concrete column and a method to support the sides of the beam on top of the wall.

In U.S. Pat. No. 5,839,249 by Roberts (filed Nov. 16, 1996) & U.S. Pat. No. 6,164,035 by Roberts (filed Nov. 23, 1998) uses a foam block with vertical holes in it which is large enough to insert a metal vertical support as well as pour a vertical concrete column after the wall has been erected. A U shaped foam block sets on top of the wall and has holes which connect to the concrete columns. Also electrical outlets are shown where the foam has been removed and conduits are installed in the wall. In U.S. Pat. No. 6,588,168 (filed Apr. 17, 2001) by Walters also uses the U shaped foam block for construction a beam on top of a foam wall. The vertical foam void shows a metal channel in one hole and a vertically poured concrete column in other holes. The vertical holes are uniform in size and therefore fixing the size of the concrete columns. Since the concrete beam is a mold, the size is also limited to change without ordering different molds for different size beams.

Another type of foam panel is U.S. Pat. No. 6,523,312 by Budge (filed Feb. 25, 2003) that uses a foam panel with an array of vertically large holes as the mold chamber for a concrete column and a hollow section on top to form a concrete beam. The foam is embedded into a concrete footing to stabilize the wall prior to pouring concrete. The wall panel uses interlocking foam to secure one panel to another and no light gauge framing is used to support the panel.

In U.S. Pat. No. 6,119,432 (filed Sep. 3, 1999) by Niemann forms a panel by cutting the polystyrene foam into a concrete beam on top and bottom of panel. In addition the foam is cut into a rib pattern then glued back to create vertical holes within the foam into which concrete is then poured into the columns and beams. The patent does disclose recessed furring strips on the exterior of the wall. The patent discloses glue as the only means of holding the two sides of the panel together. The pressure of the wet concrete will push the two sides apart and the furring channel will probably be required to hold the panel together. The ribbed foam panels limits the size, spacing and structural integrity of the concrete beams as well as the array of concrete columns.

In U.S. Pat. No. 7,028,440 (filed Nov. 29, 2003) by Brisson uses foam blocks with vertical holes to form concrete columns and uses a horizontal recess at the top of the panels to form a beam pocket. The foam panels are made using a tongue and groove type connections between panels and the panels are glued together. Since the holes for the concrete are only support by foam, the size is limited as the concrete will deform as well as break the foam panels. Again the beam pocket is also fragile as there is not support to stop the wet concrete from deforming the beam.

In US 2007/0199266 (filed Feb. 27, 2006) by Geilen is a foam block with a hole at the interior for a concrete column and a foam cavity for a beam. At the exterior of the panel, vertical recessed wood or metal furring strips are installed at the column cavities of the panel and function as a wall forming structure. The interior portion of the foam panel is a tongue and groove construction interlocking adjacent panels together. A horizontal void in the interior foam forms a beam pocket at the top of the wall and the recess strips support the sides of beam pocket. The recessed furring strips at the corners, shown in conjunction with the concrete columns, cannot support to hold the wet concrete within the panel. The panel does not appear strong enough to support the wet concrete at the columns and especially at the wall corners. The columns are limited in size based on the size of the wall and require specially made forms to create different sizes.

In US 2008/0066408 (filed Sep. 14, 2006) by Hileman is a rigid foam block that has six vertical chambers and a horizontal mold at the top and bottom of each the foam block. When the rigid blocks are installed together they will form a wall with an array of small vertical and horizontal chambers into which concrete is then poured. The rigid foam block limits the concrete column and beam spacing for a wall.

E. Triangular Stud

Light gauge metal is configured in many different shapes and therefore a forming mold should be analyzed with many different shapes.

In U.S. Pat. No. 5,279,091 (filed Jun. 26, 1992) by Williams uses a triangular flange and a clip to install a demountable building panel of drywall.

In U.S. Pat. No. 5,207,045 (filed Jun. 3, 1991), U.S. Pat. No. 5,809,724 (filed May 10, 1995), U.S. Pat. No. 6,122,888 (filed Sep. 22, 1998), by Bodnar described a triangular stud and in U.S. Pat. No. 7,231,746 (filed Jan. 29, 2004) by Bodnar shows wall studs that are wrapped and the wall stud is partially embedded into a concrete column are cast and within the framing of a precast wall.

H. Foam Tape on Studs

Foam tape is shown on metal and wood channels to reduce the conductivity between different building materials.

In U.S. Pat. No. 6,125,608 (filed Apr. 7, 1998) by Charlson shows an insulation material applied to the flange of an interior support of a building wall construction. The claims are very broad since insulating materials have been applied over interior forming structures for many years. The foam tape uses an adhesive to secure the tape to the interior building wall supports.

J. Plastic or Related Panel Connectors

Connector type patents are typically full width poured concrete walls. The plastic connectors hold the panels together and are made of various configurations.

In U.S. Pat. No. 5,809,726 (filed Aug. 21, 1996), U.S. Pat. No. 6,026,620 (filed Sep. 22, 1998) and U.S. Pat. No. 6,134,861 (filed Aug. 9, 1999) by Spude uses a connector that has an H shaped flange at both ends of the connector and connected by an open ladder shaped web. The connector is not an ICF block type connector, but long and is used both vertically and horizontally within the wall. All the Spude patents refer to a full width poured concrete wall. Sometimes the connector is located at the exterior surface; another is embedded within the panel surface.

In U.S. Pat. No. 6,293,067 (filed Mar. 17, 1998) by Meendering uses the same H shaped flange at both ends of the connector; however the web configuration is different. Also in U.S. Pat. No. 5,992,114 (filed Apr. 13, 1998) & U.S. Pat. No. 6,250,033 (filed Jan. 19, 2000) by Zelinsky also uses the same H shaped flange at both ends of the connector, also uses a different web configuration. Also in U.S. Pat. No. 6,698,710 (filed Dec. 20, 2000) by VanderWerf also uses the same H shaped flange at both ends of the connector, also uses a different web configuration.

In U.S. Pat. No. 6,247,280 (filed Apr. 18, 2000) by Grinshpun has an inner and outer skin which has an interlocking means built-in the interior surface of the panel skins. The ends of a panel connector are V shaped and lock into the interior interlocking means of each of the building panels. The connector also can accommodate a rigid insulation board within the interior of the wall panel. The panel construction is used for a continuous concrete wall, and does not affect this patent application.

In U.S. Pat. No. 6,935,081 (filed Sep. 12, 2003) by Dunn embeds an H shaped configuration in both sides of the wall panel which is rigid insulation. The H shaped configuration also has a recessed area into which a "spreader" can be installed. The spreader is another H shaped member that can slide into the recess of each side of the wall panel.

In U.S. Pat. No. 5,566,518 (filed Nov. 4, 1994) by Martin uses rigid insulation as the sides of the wall panel. The side walls are connected by a snap-on plastic connector that fits over the edge of the side walls. When connected the rigid insulation along with the plastic connector really just form another type of ICF blocks.

In U.S. Pat. No. 6,952,905 (filed Feb. 3, 2003) by Nickel, uses connectors that have dovetail slots where bolts heads fit into and the bolt shafts fit into the stone panels. In U.S. Pat. No. 6,978,581 (filed Sep. 7, 1999) by Spakousky uses dovetail slots with connectors, however the connectors do not allow for additional fasteners to be installed after concrete is installed within the mold and the connectors have a divider with two chambers within the wall. In U.S. Pat. No. 7,415,805 (filed Aug. 26, 2008) by Nickerson uses slit slots or dovetail slots to support the anchors within a wall. Nickerson also uses a tie assembly with a shank, two clamps, a support, saddle and end caps; or a tapered plug to fit into the dovetail slots to secure the block faces.

There are many ICF's manufactured, for example, U.S. Pat. No. 6,378,260, U.S. Pat. No. 6,609,340, just to name a few.

SUMMARY OF THE INVENTION

The present invention relates to forming column and beam molds using the structural insulating core wall with its support channels and rigid insulation spacer blocks between the support channels along with inner and outer boards to form column and beam molds into which concrete can be poured when installed vertically as a wall.

Various types of connections are shown to form the column and beam molds including the twist connector, twist connect channel, bent flange channel and flange extension all forming different column and beam molds but maintaining the function of holding the inner and outer boards together and eliminating concrete from entering the connectors or channels. In addition foam material can be added within channels to also eliminate concrete from surrounding the flanges. The horizontal bracing channel connects the structural insulating cores on both sides of the concrete columns as well as connecting the beam to the structural insulating core. A plate can be installed over the horizontal bracing channels forming chase where electric wiring can pass through the concrete columns.

The present invention relates to an improved wall system wherein column and beams molds uses various wall forming structures and spacer blocks interconnecting between each other. The spacer blocks have vertical and horizontal interlocking tongue and groove connections that connect between the wall forming structure and the spacer blocks. The projections of the spacer blocks cover the flanges of the support channels and the thickness of the projections is the thickness of the inner and outer boards used to form the concrete beams and columns molds.

DESCRIPTION OF THE PREFERRED EMBODIMENTS

Figure 1:
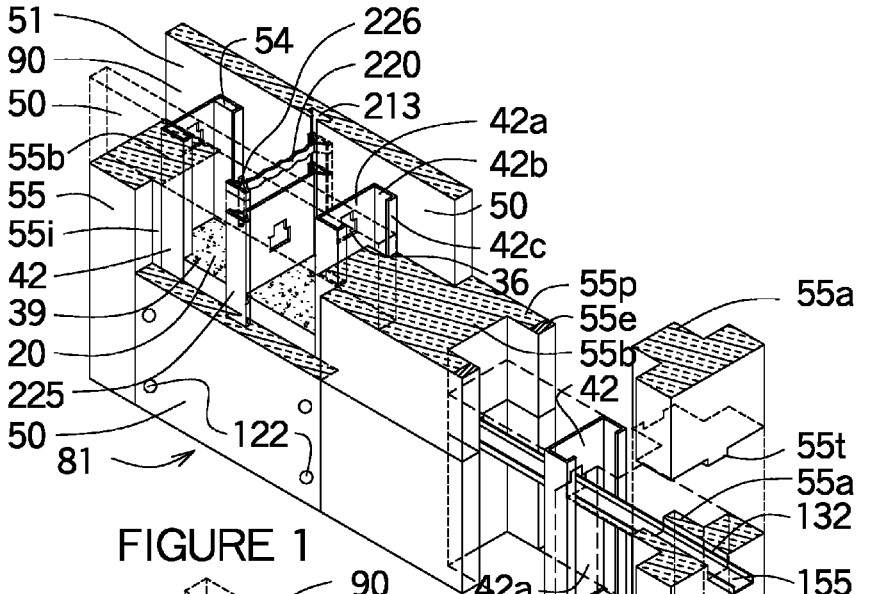
FIG. 1 shows an isometric view of the structural insulating wall where the spacer blocks are wider than the support channels, interlock between the support channels and interlock between horizontal bracing channels and the spacer blocks having a horizontal tongue fit into a trough connecting the support channels together along with the base plate connections to the spacer blocks and support channels. The horizontal bracing channel connects the wall vertically and horizontally together. The various connectors and support channels show the column and beam mold connections.
Figure 2:
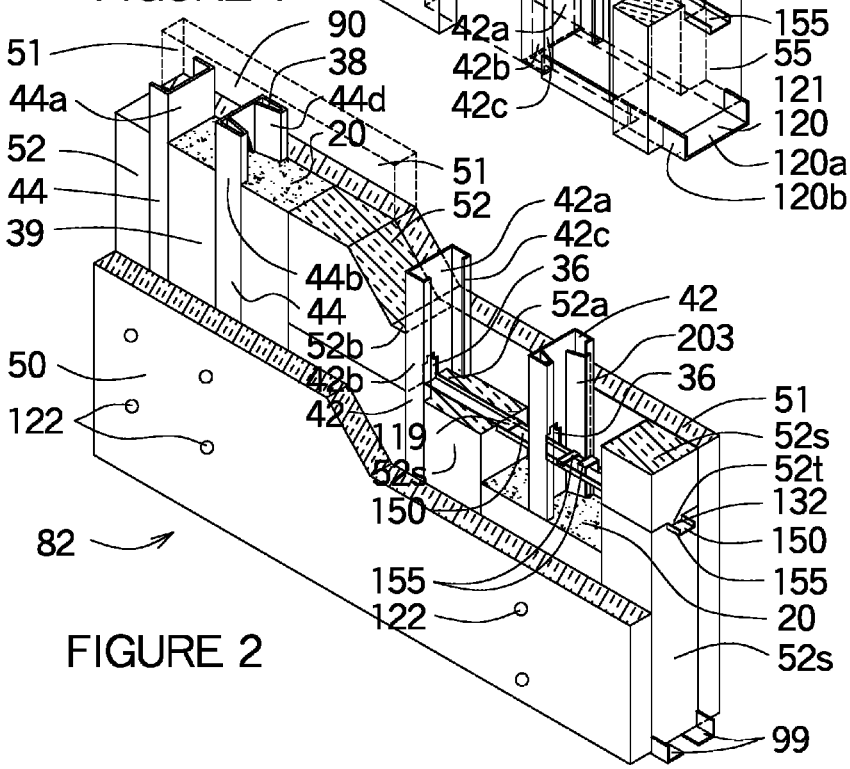
FIG. 2 shows an isometric view of the spacer insulation with inner and outer boards and various connectors interlocking the inner and outer boards together forming column and beam molds.
Figure 12A:
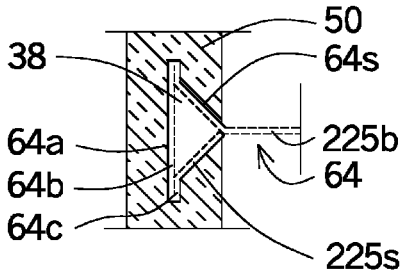
FIG. 12A shows an enlarged view of a twist connector flanges within an inner or outer board.
Figure 11:
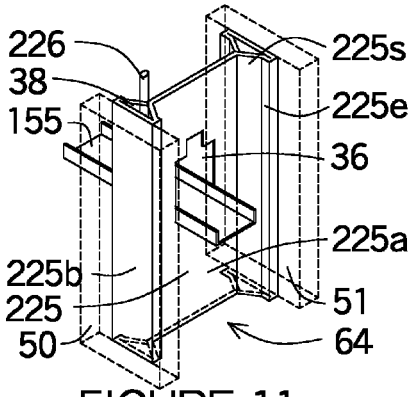
FIG. 11 shows an isometric view of the twist connector channel with a horizontal bracing channel.

FIG. 1 shows an isometric view of wall mold 81 where the column molds 20 and beam molds 90 uses foam spacers 55 fitting between vertical support channels to support and connect the wall mold 81 together. The right side shows an exploded view of the support channel as a C channel 42 with the horizontal bracing channel shown as a horizontal U channel 155 passing through the hole 36 in the web 42*a* of the C channel 42. On both sides of the C channel 42 are foam spacer 55 that have a trough 132 at the top of each foam spacer 55. The horizontal U channel 155 fits through the hole 36 and into the troughs 132 of the foam spacers 55. Another foam spacer 55 is shown above the horizontal U channel 155 where a horizontal tongue 55*t* fits into the trough 132 of the foam spacer 55 below. The trough 132 is deeper than the horizontal U channel 155 so to allow space for any mechanical/electric utilities to pass through. All the foam spacer 55 are shown deeper than the length of the web 42*a* of the support channel so projection 55*p* can extend over the flanges 42*b* of the C channel 42. The foam spacer 55 have a tongue shape 55*a* that fits between the lips 42*c* and abut the webs 42*a* and the lip 42*c* of the C channels 42 and a groove shape 55*b* where the groove shape abuts the web 42*a* of the C channel 42 and the projections 55*p* of the foam spacer 55 extends over the flanges 42*b* of the C channel 42 abutting the adjacent foam spacer 55. The base plate 120 is shown also as a horizontal U channel, however the web 120*a* is secured to a floor and the webs 120*b* are attached to the flanges 42*b* of the C channel 42 and the flanges 42*b* also slide into a groove 121 at the bottom of the foam spacer 55*p*. The left side of the figure shows three support channels at the column mold 20 where the support channels are the connectors for the column mold 20 and the beam mold 90. The left connector is a C channel 42 with foam material 54 between the web 42*a* and lip 42*c* and against the flange 42*b*. The groove side 55*b* abuts the web 42*a* of the C channel 42 and the foam spacer 55 has an indentation 55*i*. The middle connector is a twist connector channel 225, more fully explained in FIGS. 11 & 12A, is shown inserted into the "V" joint 64*a* also shown in the enlarged view in FIG. 12A. A twist connector 220 is shown above the twist connector channel 225 with a connector rod 226 passing through the cavity 38. The right connector shows a C channel 42 where the tongue side 55*a* of the foam spacer 55 fits against the web 42*a* and the lip 42*c* and the foam spacer 55 does not overlap the flange 42*b*. The column mold 20 is complete when the inner and outer board is attached to the three connectors. When the flanges 42*b* of the C channel 42 face into the column mold 20, the inner and outer boards fits against the indentation 55*i* supporting the foam spacers 55. In addition the horizontal U channel 155 passes through the foam spacers blocks 55 on the right side of the column mold 20, the horizontal U channel 155 passes through the holes 36 of the connectors (buried in the concrete 39 of the column mold) and into the foam spacer 55 on the left side of the column mold 20. The horizontal bracing channel is shown as a horizontal U channel 155 and within the column mold 20 with three different mechanical covers shown over the horizontal U channel 155. The flat electric cover 119 is shown in FIG. 2, but described and can be used in FIG. 1. The flat electric cover 119 fits over the horizontal U channel 155 and another horizontal U channel 155 shows the flanges 155*b* extending over the flanges 155*b* over the horizontal bracing channel 150 and another shows the flanges 155*b* longer extending above the horizontal U channel 155 to allow form additional mechanical wiring to pass through without having concrete flow into the horizontal U channels 155. Above the foam spacers 55 on both sides of the column mold 20 is a beam mold 90 where the support channels extend above the spacer blocks and additional connectors are installed between the inner and outer boards similar to the column mold 20 connectors.

Figure 10:
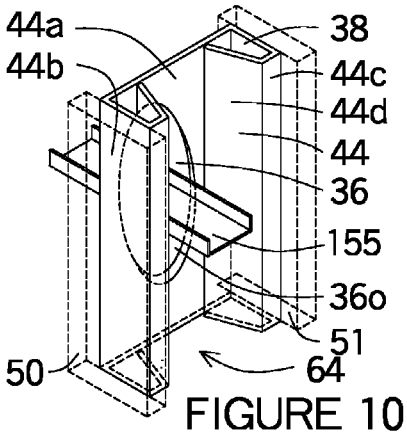
FIG. 10 shows an isometric view of the bent flange channel with a horizontal bracing channel.

In FIG. 2 shows a wall mold 82 where the spacer insulation 52 is between support channels and inner and outer boards cover the spacer insulation 52 and the support channels. The isometric view of wall mold 82 shows two column molds 20 and the left side shows a beam mold 90 above the spacer insulation 52 and the column mold 20. The beam mold 90 shows the rigid insulation 51 in ghost and the rigid board 50 needs to be extended to the height of the rigid insulation 51 to form the opposed side of the beam mold 90. The left column mold 20 show a U channel 41 as both a connector and as a wall support for the wall mold 82. The flanges 41*b* enclose the sides of the spacer insulation 52 so fasteners 37 can be attached. The web 41*a* and the spacer insulation 52 on the opposite side form the other sides of the column mold 20. The connector in the middle of the column mold 20 is a bent flange channel 44 more fully described in FIG. 10. No steel reinforcing is shown but can be installed after the wall is installed in a vertical position. Light gauge metal channels have one flange, so the double flanges 44*b* and 44*d* allow two surfaces into which a fastener 37 can attach to and thereby increasing the strength a fastener 37 can attached to support the rigid board 50 as well as resist the force of wet concrete 39 pushing against the rigid board 50. When the wall mold 84 is erected vertically the steel reinforcing 60 is added and the column mold 20 is filled with concrete 39. Upon doing so the web 44*a* and the bent flanges 44*b* & 44*d* form a cavity 38 which is also shown in FIG. 10. Since the cavity 38 is not filled with concrete 39 as typically the small space between the web 44*a* and the bent flange 44*d* is not large enough to allow concrete 39 to flow into. When additional materials shown (in ghost) is applied to the rigid board 50, the fastener (not shown) can then penetrate the rigid board 50 and into the bent flange channel 44 without having to penetrate into the concrete 39 within the column mold 20. Usually C channels or U channels (not shown) are between the column molds 20 to support the structural insulating core 111 between column molds 20 as well as to support the beam molds 90. The column mold 20 on the right side shows the spacer insulation 52 as the side supports for the column mold 20 and the rigid board 50 and rigid insulation 51 support the other two sides of the column mold 20. The connector 64 in the middle of the column mold shows a C channel 42 with flange extension 203 which forms a flange configuration similar to the bent flange channel 44. There are many other flange extensions besides the flange extension 203 shown in FIGS. 13 & 14. The spacer insulation 52 can be a full height within a wall or several shorter spacer insulations 52 can fit together to form a full height wall from the angle base plates 99 to the bottom of the beam mold 90 and with support channels spaced between the spacer insulation 52 to form a wall mold 82. The wall mold 82 length is the distance between column molds 20. The support channels shown in FIG. 2 are C channels (only one shown) where the spacer insulation 52 has a tongue side 52*a* and a groove side 52*b*. The tongue side 52*a* fits between the lips 42*c* and against the web 42*a* of the C channel 42 and the groove side 52*b* fits against the web 42*a* of another C channel 42. The tongue side 52*a* and groove side 52*b* are shown intersecting the C channel 42. The smaller spacer insulations 52*s* are formed as blocks where the smaller spacer insulations 52*s* also have horizontal interlocking configurations in addition to tongue side 52*a* and the groove side 52*b*. When several smaller spacer insulations 52*s* are stacked above each other, a trough 132 of one spacer insulation 52 connects with a horizontal tongue 52*t* of the adjacent spacer insulation above or below the spacer insulation 52. Sometimes a horizontal bracing channel 150 passes through the holes 36 of support channels and the horizontal U channel 155 fits into the trough 132 and the horizontal tongue 52*t* fits between the flanges 155*b*. The horizontal bracing channel 150 also passes through the column mold 20 for additional support as well as shown as a connector 64 since it also connects both sides of the column mold 20. Since not all sides of the column molds 20 have support channels at the sides of the column molds 20, and the rigid boards 50 and rigid insulation 51 have fasteners 37 attached to the connectors within the column molds 20 as well as the support channels within the structural insulating core wall. The beam mold 90 is formed when the connectors 64 and the support channels within the structural insulating core 111 extend above the spacer insulations 52 and the rigid boards 50 and rigid insulations 51 extend to the top of the beam mold 90 so fasteners 37 can be installed. FIGS. 1 & 2 are similar as they both require the inner and outer boards over the column mold 20 and beam molds 90; however FIG. 2 requires the inner and outer boards over the spacer insulation 52 to form the wall mold 82.

Figure 3:
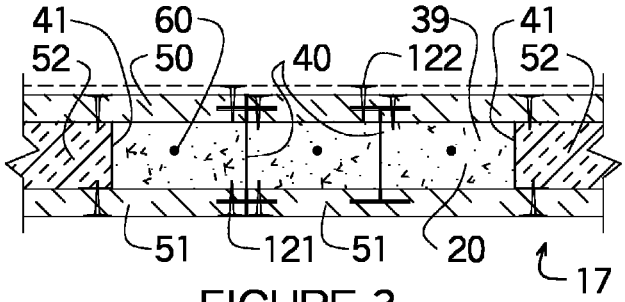
FIG. 3 shows a plan view of H channels and U channels forming a column mold.

FIG. 3 shows a plan view of wall mold 17 with support channels shown as U channels 141 and spacer insulation 52 on both sides of the column mold 20. The structural insulating core consists of the spacer insulation 52 between the rigid board 50 and rigid insulation 51 with support channels spaced between the spacer insulations 52. The column mold 20 has a support channel on both ends of the column mold 20 shown as a U channel 41 or as a connector since the U channel 41 is part of the column mold 20. Both U channels 41 have the flanges 41*b* facing toward the spacer insulation 52 and the web 41*a* form the sides of the column mold 20. Since the rigid board 50 and the rigid insulation 51 are separate elements to the spacer insulation 52, the inner and outer walls are part of the structural insulating core 111 and the column mold 20. The two connectors 64 are shown as H channels 40 that have grooves 121 formed into the rigid board 50 and rigid insulation 51. The H channel 40 on the left shows two rigid board 50 and two rigid insulation 51 meeting at the H channel 40 requiring groove 121 to be installed at the edges. The other H channel 40 shows a groove 121 formed as a T shape to conform to the end configuration of the H channel 40. Various screws 122 are used to support the column mold 20 together as well as a means of attaching additional inner and outer boards to the column mold 20 and the structural insulating core 111. Depending on the size of the column mold 20, additional H channels 40 along with additional rigid board 50 and rigid insulation 51 can be installed between the H channels 40 forming a longer column mold 20.

Figure 4:
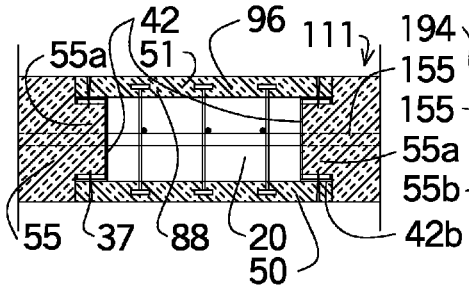
FIG. 4 shows the spacer block without the projections connected to C channel and inner and outer boards attach to the flanges.
Figure 5:
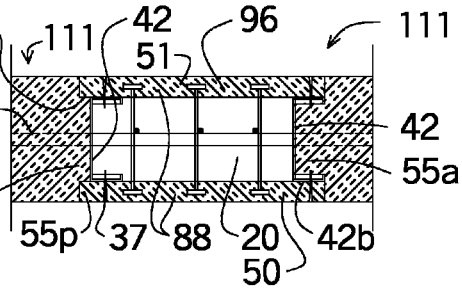
FIG. 5 shows one C channel is embedded into the column mold with rigid boards at the flanges.

FIGS. 4 & 5 both show a column mold 20 between a structural insulating core 111 walls on both sides of the column mold 20. The various connectors 64 as shown in FIG. 1, 2 or 3 can be used in FIGS. 4 & 5. Both FIG's have a support channels from the structural insulating core 111 shown at the sides of the column mold 20 and since the C channels 42 are part of the column mold 20 the support channels are also connectors. The C channels 42 in FIG. 4 show the flanges 42*b* and lips 42*c* facing toward the spacer blocks 55 where each C channel 42 is connected by the tongue side 56*a* of the spacer block 55. FIG. 5 shows the C channel 42 facing in the same direction causing the C channel 42 on the left side of the column mold 20 to have the groove side 56*b* of the spacer block 55 abut the web 42*a* of the support channel. In order to make a strong connection an indentation 194 is installed in the spacer block 52. On the right side of the column mold 20, the tongue side 56*a* fits between the flanges 42*b* and the lip 42*c* and extends to the web 42*a* the width extends past the lips 42*c* to the other edge of the spacer block. The rigid board 50 and the rigid insulation 52 are attached to the flanges 42*b* of the C channel 42. The horizontal bracing channels 150 are shown passing through the holes 36 shown in FIGS. 1 & 2 connecting the support channels together. The column mold 20 can also be formed as ICF block molds 96 with rigid foam block faces 88 and connectors made of plastic. There are many insulated concrete forms (ICF's) on the market with many different types of connectors. None of the ICF's form column molds 20 nor beam molds 90 (shown if FIGS. 8 & 9) with structural insulating cores 111 on either side using support channels and the horizontal bracing channel as connectors to form column molds 20.

Figure 6:
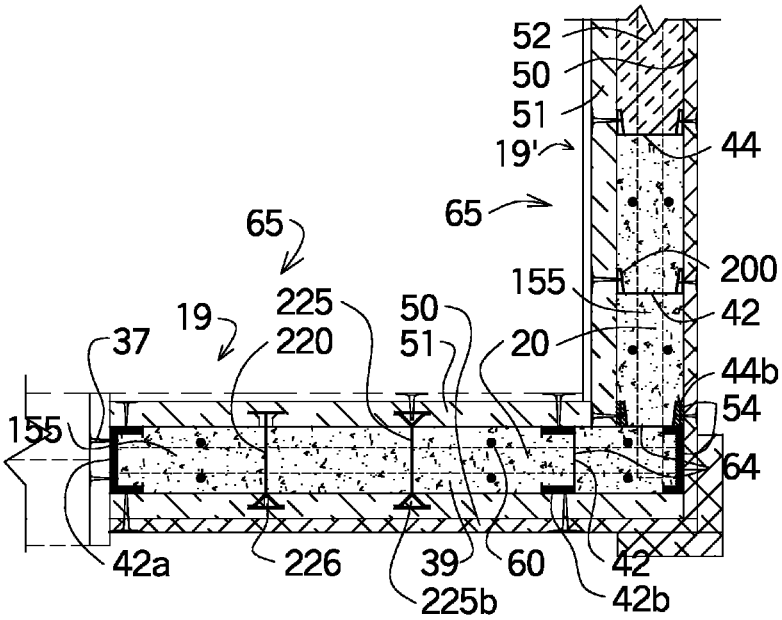
FIG. 6 is a plan view of two panels intersecting forming an "L" shaped column mold and the column molds showing several types of connectors and support channels.

FIG. 6 shows two wall panels 65 intersecting at a corner forming a column mold 20 that is L shaped. The wall panel 65 in wall molds 19 & 19' consists of a rigid board 50 and rigid insulation 51 using connectors 64 between the inner and outer surfaces of wall panels 65. The column molds 20 in each panel form an "L" shape column mold with the various connectors 64 shown in some of the previous figures include: a foam material 54 attached to C channel 42, bent flange channel 44, twist connector 220, twist connector channel 225 and a twist connector rod 226, while another wall panel 65 shown as wall mold 19' has the C channel 42 with flange extensions 200, a bent flange channel 44 connected to the rigid board 50 and rigid insulation 51. A door (shown in ghost) has the foam material 54 shown on the interior side of web 42*a* of the C channel 42 so the door (shown in ghost) can be attached to the wall panel 65 after the concrete 39 has cured. The "L" shaped column mold is partially formed in wall mold 19, and partially formed in wall mold 19'. When the wall mold 19 & 19' are installed vertically and connected together, column mold 20 is formed. Additional steel reinforcing 60 is installed within the column mold 20 and concrete 39 is installed when the walls are erected in a vertical position creating an L shaped column. Typically the column mold 20 would be used when two walls molds intersect at 90 degrees or at any angle. The "L" shaped column at the corner of a building has the integrity of a solid concrete wall or shear wall (more commonly used like diagonal bracing for wind shear), but in not a solid concrete wall since the spacer insulation 52 separates each concrete column 35 within a building structure. The horizontal bracing channel shown as a horizontal U channel 155, passes through the holes of the various connectors connecting the wall panels 65 together.

Figure 7:
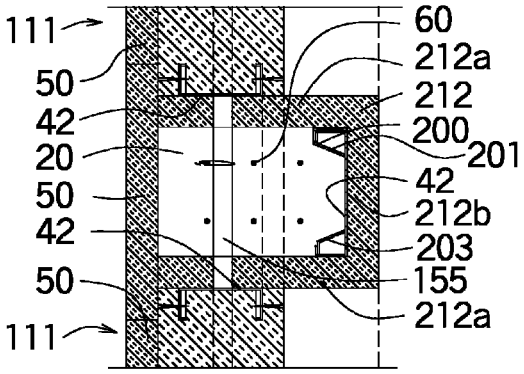
FIG. 7 shows a plan view of the spacer blocks on either side of the column mold that is wider than the column mold with a connector being a C channels with flange extensions and the horizontal bracing channel connecting two sides of the column mold.
Figure 13:
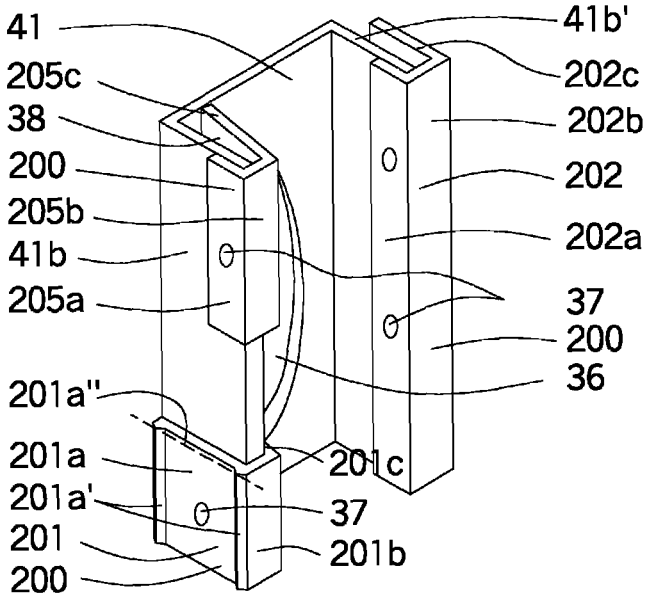
FIG. 13 shows an isometric view of a U channel with various flange extensions added to the channel.
Figure 14:
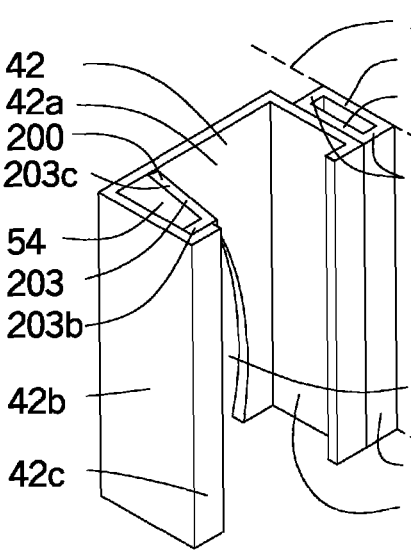
FIG. 14 shows an isometric view of a C channel with various flange extensions added to the channel.

FIG. 7 is a plan view of a column mold 20 comprising of a rigid board 50 and a one piece mold 212 that is U shaped having two sides 212*a* and a back 212*b*. The sides 212*a* of the one piece mold 212 fits between the structural insulating cores consisting of foam spacer 55 with C channels 42 and connected to the C channel 42. within the structural insulating cores. A C channel 42 within the one piece mold 212 is installed at the sides 212*a* and back 212*b* within the one piece column mold 212 for additional strength. The connector has flange extensions 200 and enlarged in FIGS. 13 & 14 are shown attached to the C channel 42 within the one piece mold 212 for easy installation of additional wall materials like drywall (not shown). The one piece mold 212 can be a rigid material like polystyrene or aerated autoclave concrete. The same material shown in the one piece mold 212 is shown as a rigid board 50 installed over the structural insulating cores as well as another rigid board 50 is shown as forming the fourth side of the one piece mold 212. The one piece mold and the rigid board 50 can all be connected to the C channels 42 within the structural insulating core by fasteners 37 (not shown). A horizontal bracing channel shown as a horizontal U channel 155 passes through the one piece mold 212 between the structural insulating cores on both sides of the one piece mold 212 and connected to the vertical reinforcing steel 60.

Figure 9:
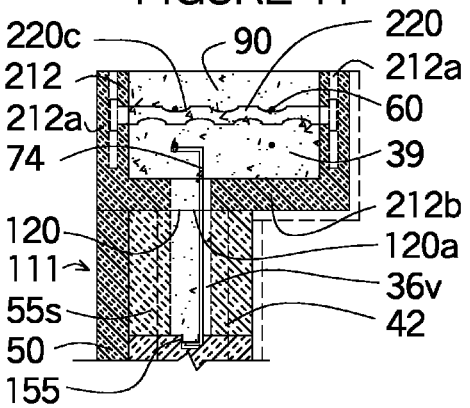
FIG. 9 shows a wall section of a wide column mold above the spacer block with a twist connector and the horizontal bracing channel connected to the beam mold.

FIGS. 7 & 9 are similar as the structural insulating core uses foam spacers 55 and C channels 42 in both figures and the beam mold 90 and the column mold 20 use the one piece mold 212. Not all rigid boards have similar insulating properties, and therefore must be distinguished to be of different materials. FIG. 7 shows the rigid boards 50 attached to the C channels 42 to form the column mold 20 and FIG. 9 shows a wall section with the rigid boards 50 attached to the structural insulating core. The rigid board 50 can either be glued to the structural insulating core 111 or attached with fasteners (not shown) to the C channels 42. The beam mold 90 can be formed as one piece mold 212 having 2 sides 212*a* and a bottom 212*b*. The one piece mold 212 can be of the same material as the rigid board 50. A base plate 120 can be installed over the structural insulating core so an anchor bolt 74 can be installed through the web 120*a* into the beam mold 90. Concrete 39 and reinforcing steel 60 are installed within the beam mold 90. The connector is shown as a twist connector 220 used to support the 2 sides 212*a* of the beam mold 90. The twist connector 220 is shown in more detail in FIGS. 12A, 12B & 12C. The smaller spacer insulation 55*s* is shown below the beam mold 90 with a vertical hole 36*v* and an anchor bolt 74 that attaches the horizontal bracing channel shown as a horizontal U channel 155 to the reinforcing steel 60 within the beam mold 90.

Figure 8:
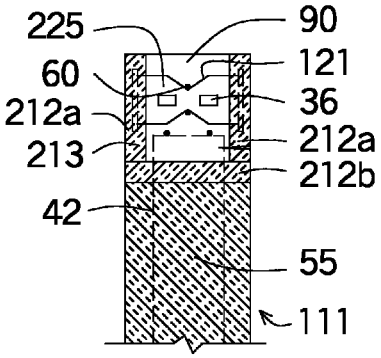
FIG. 8 shows a wall section with a connector attached to the inner and outer wall boards and the support channels extending into the beam mold.

FIGS. 7, 8 & 9 are similar since both figures use a one piece mold 212 for the column mold 20 and the beam mold 90 along with the structural insulating core 111. The figures show the rigid board 50 attached to the structural insulating core 111 and FIG. 7 uses the rigid board 50 as part of the column mold 20. FIG. 8 also uses a one piece mold 212 to form the beam mold 90 above the structural insulating core 111 along with the twist connector channel 225 is used with the V joint 64*a* shown enlarged in FIG. 12A. The support channels from the structural insulating core 111 pass through the one piece mold 212 connecting the structural insulating core 111 to the concrete 39 (not shown) into the beam mold 90. In FIG. 8 the one piece mold 212 is shown as three pieces, two sides—212A and one bottom—212B which could also be formed using rigid boards 50 as shown in previous figures. Concrete 39 and reinforcing steel 60 are installed within the beam mold 90. In FIG. 9 a twist connector 220 can be used to support the 2 sides 212*a* of the beam mold 90 and secured by the dovetail joint 213. The twist connector 220 is shown in more detail in FIGS. 12B & 12C. The smaller spacer insulation 55*s* is shown below the beam mold 90 with a vertical hole 36*v* and an anchor bolt 74 that attaches the horizontal bracing channel shown as a horizontal U channel 155 to the reinforcing steel 60 within the beam mold 90.

FIG. 10 the connector is a bent flange channel 44 which is similar to the C channels 42 previously described. The bent flange channel 44 has a web 44*a*, a flange 44*b* that is perpendicular to the web 44*a*, a bent flange 44*d* being parallel to the web 44*a* with a hole in the web 44*a*. The bent flange channel 44 has a web 44*a* which is the same width as the spacer insulation 52. The bent flanges consist of two parts, the flange 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. The light gauge metal used in forming metal channels has limited strength. By using two double flanges 44*b* and 44*d*, the two surfaces increase the strength of the channel as well as increasing the strength of the connection with the fastener 37. FIG. 2 shows the bent flange channel 44 also as a connector 64 where the flanges 44*b* abut the rigid board 50 and the rigid insulation 51 and screws 122 as well as secured to the bent flange 44*d*. Additional finishes (not shown) can be installed into the bent flange channel 44 after concrete 39 has been installed into the column mold 20 by installing the screws 122 through the flange 44*a* into the cavity 38. FIG. 6 shows the bent flange channel 44 as a support channel and as a connector 64 since the web 44*a* is part of the column mold 20 and the flange 44*b* and the return flange 44*c* are connected to the inner and outer boards and the spacer insulation 52 fits between the return flanges 44*c*. In addition, the bent flange channel 44 shows foam material 54 installed between the flange 44*b* and the inner and outer boards, as well as within the cavity 38.

FIG. 11 shows an isometric view of a twist connector channel 225 which has a web 225*a* with a hole 36 and connected by flange heads 225*b* at both ends of the twist connector channel 225. The horizontal bracing channel shown as a horizontal U channel 155 to pass through the hole 36 in the web 225*a*. The flange heads 225*b* are shown (in ghost) in FIG. 12A and described as a part of the connector 64. Since the twist connector channel 225 has a web 225*a*, the twist connector channel 225 must be slid into an inverted V shaped slot 64*a* as shown in FIG. 12A. The flange heads 225*b* are V shaped where the vortex of the V is connected to the web 225*a*, and the sides of the V are two sloped sides 225*s* having two extending legs 225*e* and a back 225*w* which is the width of the flange heads 225*b*. Shorter sections or brackets of the twist connector channel 225 can be installed within the V shaped slot allowing several brackets to be used as connectors between the inner and outer boards.

FIG. 12A shows an enlarged plan view of a groove shown as V shape groove 64*a* where a connector can slid into. The twist connector channel 225 in FIG. 11 is shown in ghost in FIG. 12A and has a similar edge profile that can fit into the V shape groove 64*a*. The V shape groove 64*a* recessed into rigid board 50 as shown in FIGS. 1, 6, 8 & 9. After the rigid board 50 or rigid insulation are cut into slabs, the material needs to be cut or routed to form the V shape groove 64*a* into which the edge profile of the flange heads 225*b* of the twist connector channel 225 or connector heads 220*a* (without twisting) can be slid into the V shape groove 64*a* of the rigid board 50 or rigid insulation 51 as shown in FIG. 1. The V shape groove 64*a* should conform to the edge profile of the connector. In FIG. 11 the edge profile of the twist connector channel 225 are the flange heads 225*b*. When the twist connector channel 225 is installed within the V shape groove 64*a* the flange heads 225*b* create sufficient friction from being pulled from the V shape groove 64*a* within the inner and outer boards, and is similar to the dovetail joint 213 in FIGS. 12B & 12C. The extended leg 64*c* of the V shape groove 64*a* is shown to add additional resistance and strength to the holding capacity of a connector 64. The flange heads 225*b* of the twist connector channel 225 in FIG. 11 and the connector heads 220*a* of the twist connector 220 in FIGS. 12B & 12C can both use the same V shape groove 64*a*. The edge profile of the rigid foam block faces 88 & 88' in FIGS. 4 & 5 can be interchanged with rigid board 50 or rigid insulation 51. In addition, the connectors can be of rigid plastic as well as metal as described earlier. The twist connector channel as described in FIG. 11 has a cavity 38 similar to the cavity 38 of the bent flange channel 44 in FIG. 10. The V shape groove 64*a* conforms to the two sloped sides 225*s*, the extending leg 225*e* and the flange heads 225*b* of the twist connector channel 225 shown in FIG. 11.

Figure 12B:
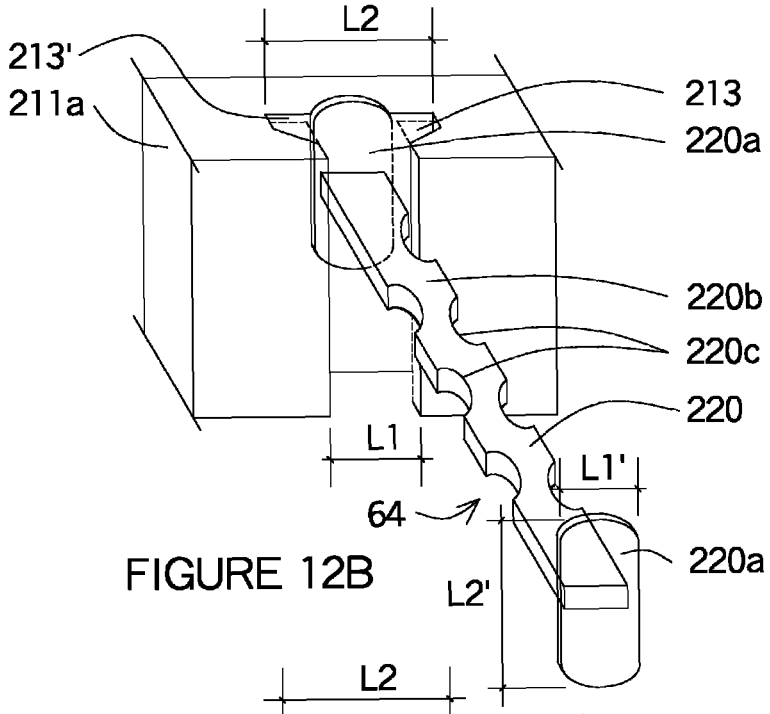
FIG. 12B shows an isometric view of a twist connector fitting into the dove tale slot prior to being twisted into place.
Figure 12C:
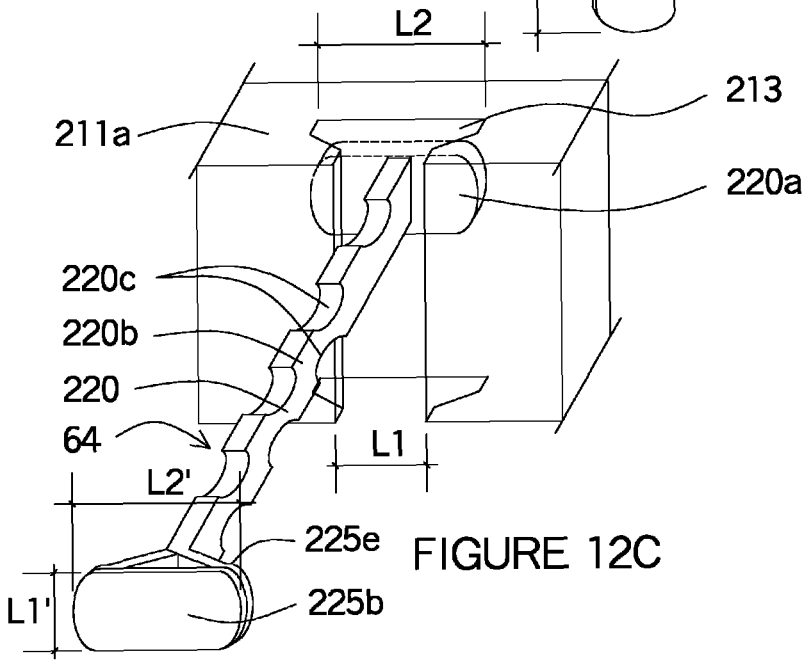
FIG. 12C shows an isometric of the twist connector where one side has a twist connector configuration and the opposite side having a plain end and locked into position of the dove tail groove.

FIGS. 12B and 12C show a twist connector 220 in an inserting position at FIG. 12B and the fixed position in FIG. 12C. As stated earlier the twist connector 220 is shown installed in the beam mold 90 in FIG. 9 in the one piece mold 212 and also in FIG. 1 between the rigid board 50 and the rigid insulation 51 in the dovetail joint 213. The dovetail joint 213 is similar to the invert V shaped 64*a* shown in FIG. 12A; however the dovetail joint 213 has a wide opening at the interior side shown as L1 and a wider opening within the middle of the side wall 210*a* shown as L2. The twist connector 220 shown in FIGS. 12B & 12C has two connector heads 220*a* connected by a connector shaft 220*b*. The connector heads 220*a* are shown having a narrow width L1' slightly larger than the connector shaft 220*b* and less than the opening L1 of the dovetail joint 213 shown as L1. FIG. 12B shows the connector head 220*a* shown in a vertical position; where the smaller connector head L1' is inserted through the interior side L1 of the dovetail joint 213. The connector head 220*a* is then turned or twisted 90 degrees within the dovetail joint 213, so that the long length L2' of the twist connector 220 is turned the full width L2 of the dovetail joint 213. When the twist connector 220 is turned 90 degrees within the dovetail joint 213, the twist connector 220 is locked into position within the side wall 211*a*. The twist connector shaft 220*b* is rectilinear in shape and when the twist connector 220 is in the locked position, the twist connector shaft has a rebar depression 220*c* so steel reinforcing (not shown) can be installed in the rebar depressions 220*c* as shown in FIG. 9. In FIG. 12C one of the twist connector heads 220*a* is shown having the flange heads 225*b* with the flange head extension 225*e* as shown in FIGS. 11 & 12A.

Figure 15:
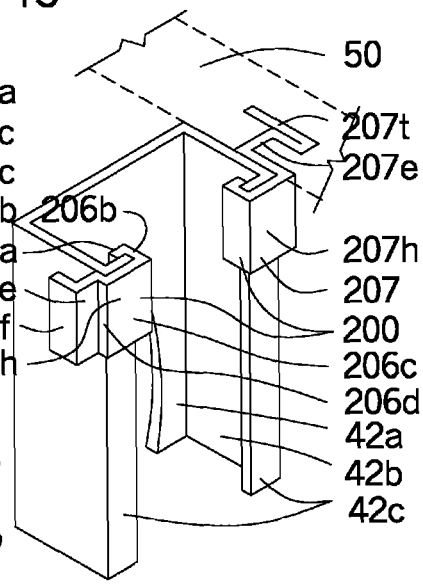
FIG. 15 shows a snap-in-place configuration of two flange extensions.

FIGS. 13, 14 & 15 shows various types of connectors 64, but are referred to as flange extensions 200 since the extensions are added to the end of the connectors 64. The flange extensions 200 are different configurations that are added to the U channel 41 and/or C channel 42 that changed the shape of the flanges 41*b* or 42*b* of the U channel 41 or C channel 42. The bent flange channel 44 in FIG. 10 shows a flange variation 205 in FIG. 13 where the flange variation 205 is shown attached to the U channel 41 at 205*a*, then bent at 205*b* around the flange 41*b* of the U channel 41 and continues at an angle shown at 205*c* to the web 41*a* forming a cavity 38. The flange variation 205 is full height of the connectors 64 since the cavity 38 is meant to allow fasteners (not shown) to be connected to the U channel 41, through the flange variation 205 and into the cavity 38. Another flange extension 200 shows the flange variation 201 being added to the flange 41*b* by creating a depression 201*a* to the sides of the flange 41*b*. The flange variation 201 is wrapped at the interior of the flange 41*b*, and then turned 90 degrees at 201*b* and again forming 201*a*. The side 201 shows a depression 201*a*" between two protruding elements 201*a*'. When a hard board 40 is installed over the depression 201*a* a cavity 38 is formed limiting the amount of thermal conductivity passing through the U channel 41. The flange extension 200 shows the flange variation 202 attached to the U channel 41 at 202*a*, then bent at 202*b* around the flange 41*b*, however a cavity 38 is formed between the flange 41*b* and the continuation of the flange variation 202 at 202*c*. The cavity 38 is formed so as to install a foam spacer 55 not shown between the flange 41*b* and the side 202*c*.

FIG. 14 shows a another flange extension 200 where the flange variation 203 also appears like the bent flange channel 44 in FIG. 10 except the flange variation 203 is installed by friction rather than a fastener 37 as shown in FIG. 13. The flange variation 203 has one leg 203*a* that rests against the lip 42*c* and the other leg 203*b* rests against the web 42*a* of the C channel 42. The leg 203*b* is at an angle to the web 42*b* similar to the flange variation 205. When the leg 203*b* fits against the lip 42*c* and other leg 203*c* rests against the web 42*a*, friction against the leg 203*b* to the web 42*b* holds the loose flange variation 203 in place. The flange extension 200 is also shown as a flange variation 204 which is rectangular tubular shape having sides 204*a*, 204*b* & 204*c*. The flange variation 204 can also be "C" using sides 204*a* and two sides 204*b* forming the "C" shape. By forming the rectangular tubular shape and the "C" shape a cavity 38 is formed so not to allow concrete (not shown) to flow into the cavity 38 of the column molds 20 and beam molds 90 shown in the previous figures.

FIG. 15 shows two additional flange extensions 200 shown as flange variation 206 & 207 attached to a C channel 42. The flange variation 206 wraps around the lip 42*c* of the C channel 42 forming a hook shape 206*h* shown as 206*a*, 206*b*, 206*c* & 206*d*. The hook shape 206*h* start at 206*a* at the inside of the lip 42*c*, then wraps around the lip 42*c* at 206*b*, then extends the full length of the lip 42*c*, then turns again 90 degrees onto the flange 42*b*. By wrapping the hook shape 206*h* around the lip 42*c* and making the 90 degree turn onto the flange 42*b*, the hook snaps into place. The end of the flange variation 206 turns 90 degrees away for the flange 42*b* at 206*e* and turns 90 degrees similar to flange variation 202. The flange variation 207 has the same hook shape 207*h* as does 206*h*. The end of the hook shape 207*h* the flange variation 207 turns 90 degrees shown as 207*e* then forms a "T" shape 207*t* at the end similar to the end of an H channel 40 shown in FIG. 3.

Figure 24:
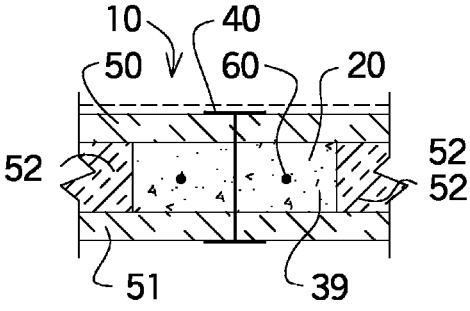
FIG. 24 shows a plan view of a column within the building wall straddling the wall forming mold.

The flange extensions 200 shown a flange variations 201-207 can be short brackets or full length depending on the height of the wall as shown in FIG. 24 and can be manufactured of plastic or metal. The flange extensions 200 are attached to the U channel 41 or C channels 42 when embedded into any of the previous described concrete molds in order to have a cavity 38 into which drywall (not shown) can be installed into the concrete molds.

Figure 16:
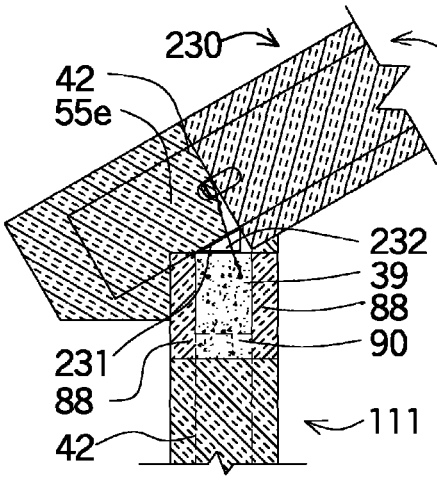
FIG. 16 is a wall section showing the structural insulating core as a roof and the concrete beam is located at the top of the wall.

FIG. 16 shows the structural insulation core 111 stopping at the bottom of the beam mold 90 and the support channels shown as C channels 42 extending the height of the beam mold 90. Inner and outer boards shown as rigid board 50 and rigid insulation 51 are attached to the flanges 42*b* of the C channels 42. Another structural insulating core 111 shown at an angle above the beam mold 90 is a roof mold 230. Concrete 39 is installed in the beam mold 90 along with a hold down strap 232 that is embedded into the beam mold 90. An angle base plate 231 is placed on top of the concrete 39 and the hold down strap 232 and the angle base plate 231 are attached to the C channel 42 within the structural insulating core 111 in the roof structure. The structural insulating core 111 at the roof can be extended by adding an extension 55*e* that is in the shape of a roof eave.

Figure 17:
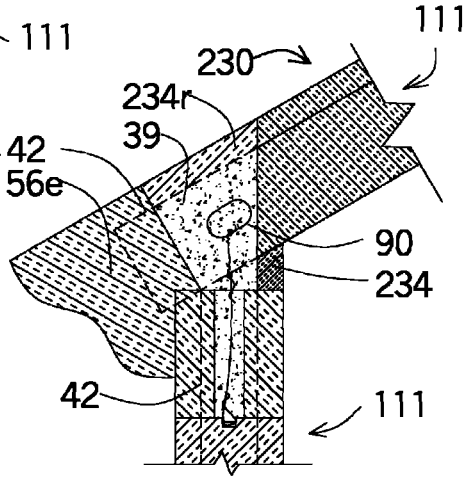
FIG. 17 is a wall section showing the structural insulating core as a roof and the concrete beams is located at the top of the wall within the roof plane.

FIG. 16 is similar to FIG. 17 except the beam mold 90 is located at the top of the structural insulating core 111 at the wall but within the structural insulating core 111 at the roof. The C channel 42 in the structural insulating core 111 at the wall is attached to the C channel 42 in the structural insulating core 111 at the roof. In FIG. 16 the extension 55*e* is attached to the C channel 42 in order to form the beam mold 90 as well as a filler insulation 234 that fills the void between structural insulating core 111 at the roof and the structural insulating core 111 at the wall. After concrete 39 is installed in the beam mold 90 filler insulation 234 can be installed above the beam mold 90.

Figure 18:
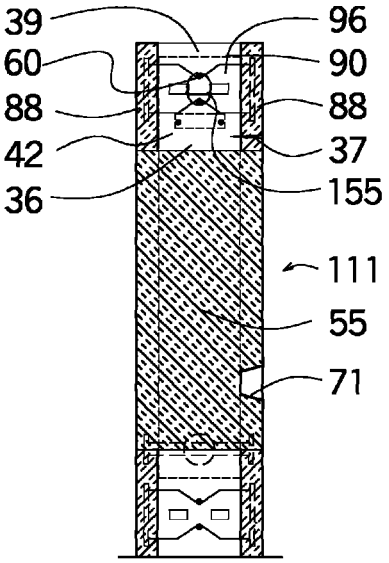
FIG. 18 shows a wall section with the structural insulating core and the ICF mold forming a concrete beam.
Figure 19:
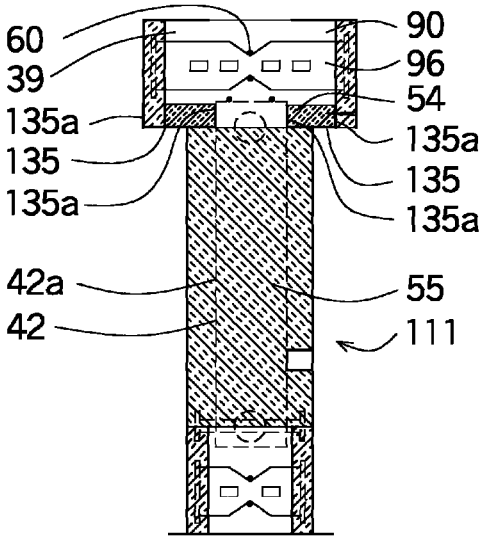
FIG. 19 shows a wall section with the structural insulating core and a larger ICF mold forming a wide concrete beam.

FIGS. 18 & 19 shows a connector from an ICF mold 96 attached to the inner and outer boards shown as rigid board 50 and rigid insulation 51. Connectors are spaced typically 8 inches apart while the support channels are usually 24 inches on center. In FIG. 18 is a wall section showing the beam mold 90 is placed above to the structural insulating core 111. The C channel 42 with holes 36 extending into the beam mold 90 and attached with a fastener 37 through the inner and outer boards. When concrete 39 is poured into the beam mold 90, the C channel 42 will be secured into the concrete 39. The horizontal bracing channel shown as a horizontal U channel 155 is passing through the foam spacer 55 as well as through the holes 36 in the C channel 42 in the beam mold 90. In addition a hat channel 71 is shown attaching to the flanges 42*b* of the C channels 42 forming an electrical chase on the surface of the foam spacer 55.

FIG. 19 shows beam mold 90 that is wider than the structural insulation core 111 below. The C channel 42 from the structural insulating core extends above the foam spacer 55 into the beam mold 90. On both sides of the C channel 42 is a brace channel 135. The flanges 135*a* are attached to the flanges 42*a* of the C channel 42 in the structural insulating core 111. The opposite flange 135*a* of the brace channel 135 is shown extending beyond the beam mold 90. Another brace channel 135 is shown at the interior side of the beam mold 90. A foam material 54 is installed at the webs 135*b* of the brace channels 135 for installing drywall (not shown) onto the beam mold 90. The inner and outer boards shown as rigid insulation 51 connects to the web 135*a* and flange 135*b* on both sides of the beam mold 90 with a connector from an ICF mold 96 attached to the foam material 54.

Figure 20:
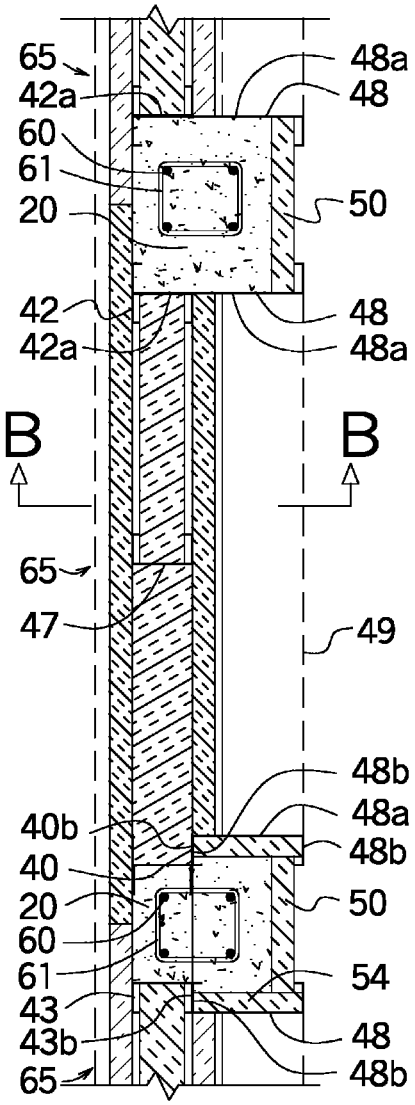
FIG. 20 shows a wall column protruding outside the limits of the wall framing structure.

FIG. 20 shows three wall panels 65 between two column molds 20 which are deeper than the wall panels 65 between the column molds 20. One column mold 20 shows a C channel 42 at the end of each wall panel 65 and other column mold 20 has an H channel 40 and C channel 42 shown at the ends of the other wall panels 65. A larger C channel 48 is shown protruding perpendicular to both the wall panels 65 and are connected to the flange 42*b* of the C channel 42 and to the flange 48*b* of the other larger C channel 48. The opposite side of the column mold 20 shows the flange 48*b* of the larger C channel 48 connecting to the flange 40*b* of the H channel 40. The web 48*a* of the large C channel 48 is shown with a foam material 54; however the foam material 54 is not really necessary unless drywall (not shown) is installed over the large C channels 48. Reinforcing steel 60 is installed within the column mold 20 and a steel stirrup 61 passes around the reinforcing steel 60. After the wall panels 65 are installed vertically, rigid board 50 is installed at the opposite flange 48*b* of each of the large C channels 48 of the wall panels 65. The other column mold 20 shows another larger C channel 48 where the web 48*a* is attached to the web 42 of the C channel 42. The large C channel 48 can be attached to the wall panels 65 prior to the erection the wall panels or can be attached after the wall panels 65 have been erected. The rigid board 50 is installed between the webs 48*a* and connected to the flanges 48*b* after the reinforcing steel 60 and steel stirrups 61 have been installed.

Figure 21:
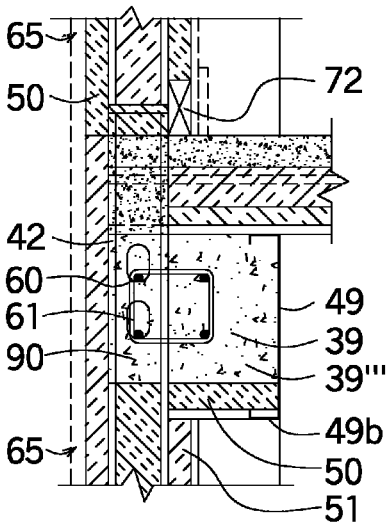
FIG. 21 shows a horizontal beam protruding outside the limits of the wall framing structure.
Figure 27:
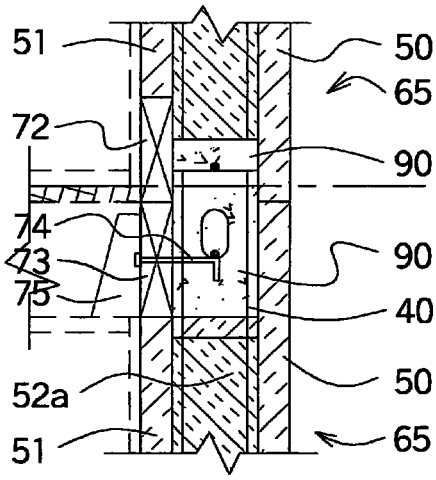
FIG. 27 shows a wall section where the horizontal beam intersects a floor as well as another wall panel above.

FIG. 21 is a wall section B-B taken through wall panel 65 in FIG. 20 where the beam mold 90 is wider and overhangs the wall panel 65. A beam support channel 49 is shown dashed in the plan view of FIG. 20 and is supported by the larger C channel 48 of the column molds 20. Horizontal reinforcing steel 60 is installed in the beam mold 90 and steel stirrups 61 are installed around the reinforcing steel 60. A rigid board 50 is placed on the flange 49*b* of the beam support channel 49 and on the rigid insulation 51 of the wall panels 65. Concrete 39 can now be installed within the beam mold 90 after the wall panel 65 is installed vertical to the height of the beam support channel 49. The spacer channel 47 shown as C channel 42 extends through the beam mold 90 and past the rigid floor system as shown in FIG. 27. The concrete 39 can be poured over the rigid floor system as well as between the C channels 42. After the rigid floor system is complete another wall panel 65 can be placed above the wall panel 65 and attached at the rigid board 50 and at the wood blocking 72.

Figure 22:
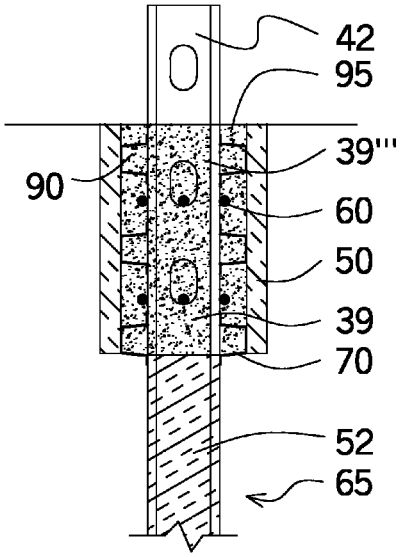
FIG. 22 shows another horizontal beam being supported by an interior framing wall structure.

FIG. 22 shows an interior wall section where a non-load bearing wall channel shown using C channels 42 being used to support beam molds 90. The C channel 42 extends above the concrete beam 39''' in order for a flooring system shown in FIG. 21 to be securely fastened to the interior wall C channel 42. In FIG. 22 the wall section shows a concrete beam 39''', which is wider than the wall panel 65 below supported by the C channel 42 in the wall panel 65. An array of hat channels 70 is secured to the C channels 42 and a rigid board 50 is secured to the hat channel 70. The wall panel 65 in FIG. 22 shows the beam mold 90 supported by spacer insulation 52 between the C channel 42 and the spacer insulation 52 is used to support the concrete 39 within the beam mold 90.

Figure 23:
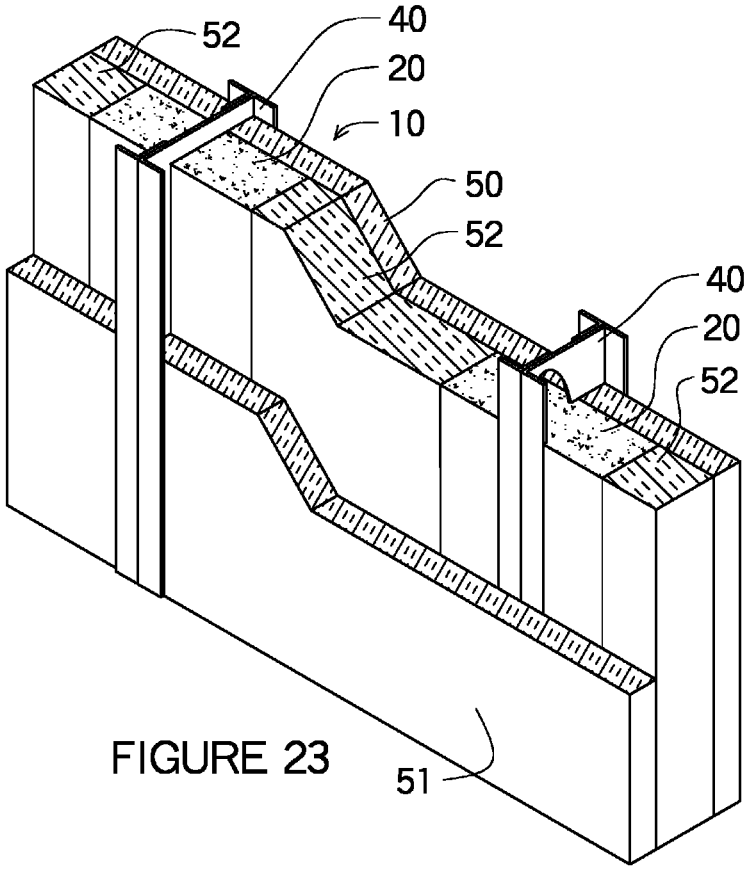
FIG. 23 is an isometric view of a column in a building wall using a wall mold structure in the middle of the column.
Figure 25:
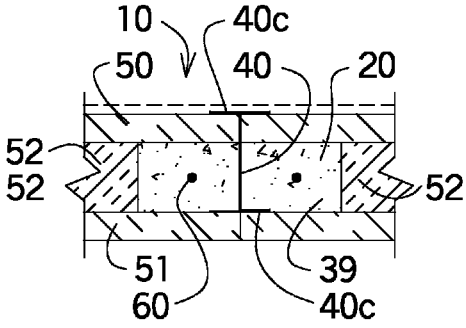
FIG. 25 shows a plan view of a column within the building wall partially embedded with the wall forming mold.

In FIG. 23 a wall mold 10 is shown in isometric view with two different configurations of column molds 20. The wall mold 10 consists of spacer insulation 52 in the middle sandwich between inner and outer rigid boards shown as a rigid board 50 and rigid insulation 51 that define the outer surfaces of the wall mold 10. The column molds 20 are also shown in a plan view drawing in FIG. 24 and FIG. 25. The width of the column molds 20 are determined by the thickness of the spacer insulation 52 located between the rigid board 50 and the rigid insulation 51. On the other hand, the width of the column molds 20 is the distance between the spacer insulations 52 on either side of the column molds 20. In FIG. 24 the support channel of the column forming structure is an H channel 40 shown at the middle of the column mold 20 extending outside of the wall mold 10 but yet an integral part of the column mold 20 securing both the rigid board 50 and the rigid insulation 51 to the wall mold 10. In FIG. 25 the H channel 40 is smaller than in FIG. 24 which allows the rigid insulation 51 to be secured to the surface of flange 40*c* of the H channel 40. The opposite flange 40*c* of H channel 40 is secured on the interior surface of the flange 40*c* making it easier to fasten another material to the H channel 40. Where the flanges 40*b* overlap the inner and outer boards no fastener 37 is required, however when the flanges 40*b* are located between the inner and outer boards a fastener 37 is required to support the column mold 20 unless an adhesive (no shown) can connect the various materials together. The depth of the column molds 20 are determined by the structural strength of the adhesive and the bending stress of the rigid board 50 and rigid insulation 51. On the other hand, the rigid board 50, rigid insulation 51 and the spacer insulation 52 could all be formed of the same material and secured together with the H channel 40. Steel reinforcing 60 can be added prior to the column molds 20 being filled with a hardenable material.

Figure 26:
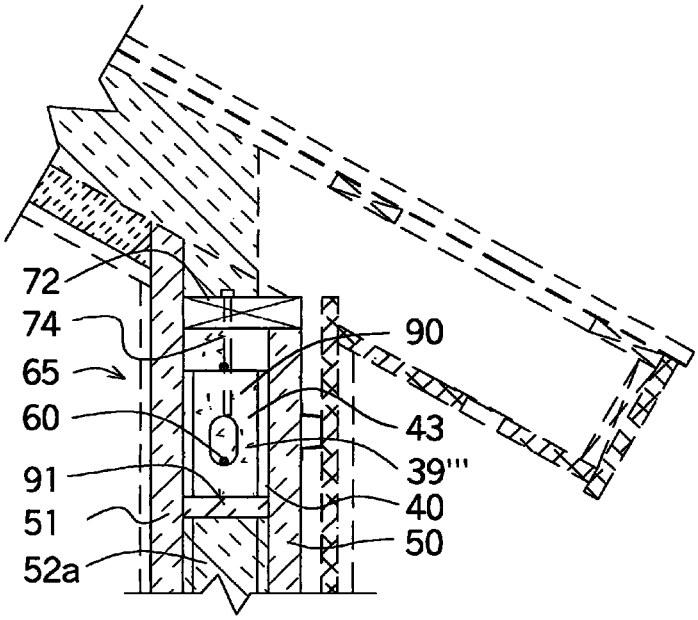
FIG. 26 shows a roof intersection the wall forming mold at a horizontal beam.

FIGS. 26 & 27 shows two wall panels 65 stacked above each other forming two beam molds 90, where the beam mold 90 in FIG. 27 uses components for a floor construction as part of the beam mold 90 and in FIG. 26 the beam mold 90 is supporting a roof construction. Even though both the floor and roof constructions are shown in wood, metal components can also be used as a substitute. The wall panels 65 are shown using spacer insulation 52 between C channels 42 and extending the depth of the C channel 42 with rigid board 50 and rigid insulation 51 attached to the C channels 42. In lieu of using spacer insulation 52 in the middle between the C channels 42, loose granular insulation 52*a* can be installed between the rigid board 50 and the rigid insulation 51 from the top of the wall panel 65 to the desired height of the bottom beam mold 90. In FIG. 27, a wood ledger 73, anchor bolt 74 and metal joist hanger 75 are used as part of the beam mold 90 and a horizontal baffle board 91 can be used above the loose granular insulation 52*a* for a more even bottom of the beam mold 90. FIG. 26 also shows the horizontal baffle board 91 being used rather than the spacer insulation 52. Another alternative in FIG. 27 is to allow the C channel 42 to extend above the beam mold 90 and install two angles 99 as a top base plate 120 the fill the beam mold 90 and surrounding column molds 20 (not shown in this wall section). When forming the wall panel 65 above, allow the rigid boards 50 and rigid insulations 51 to extend the length of angle 99 and recess the C channel 42 the same distance in order to interlock the wall panels 65 together. Wood blocking 72 can be installed at the top of the wall panel 65 to connect to the wood roof joists (shown in ghost). An anchor bolt 74 connects the wood blocking directly into the concrete 39 within the beam mold 90.

Figure 28:
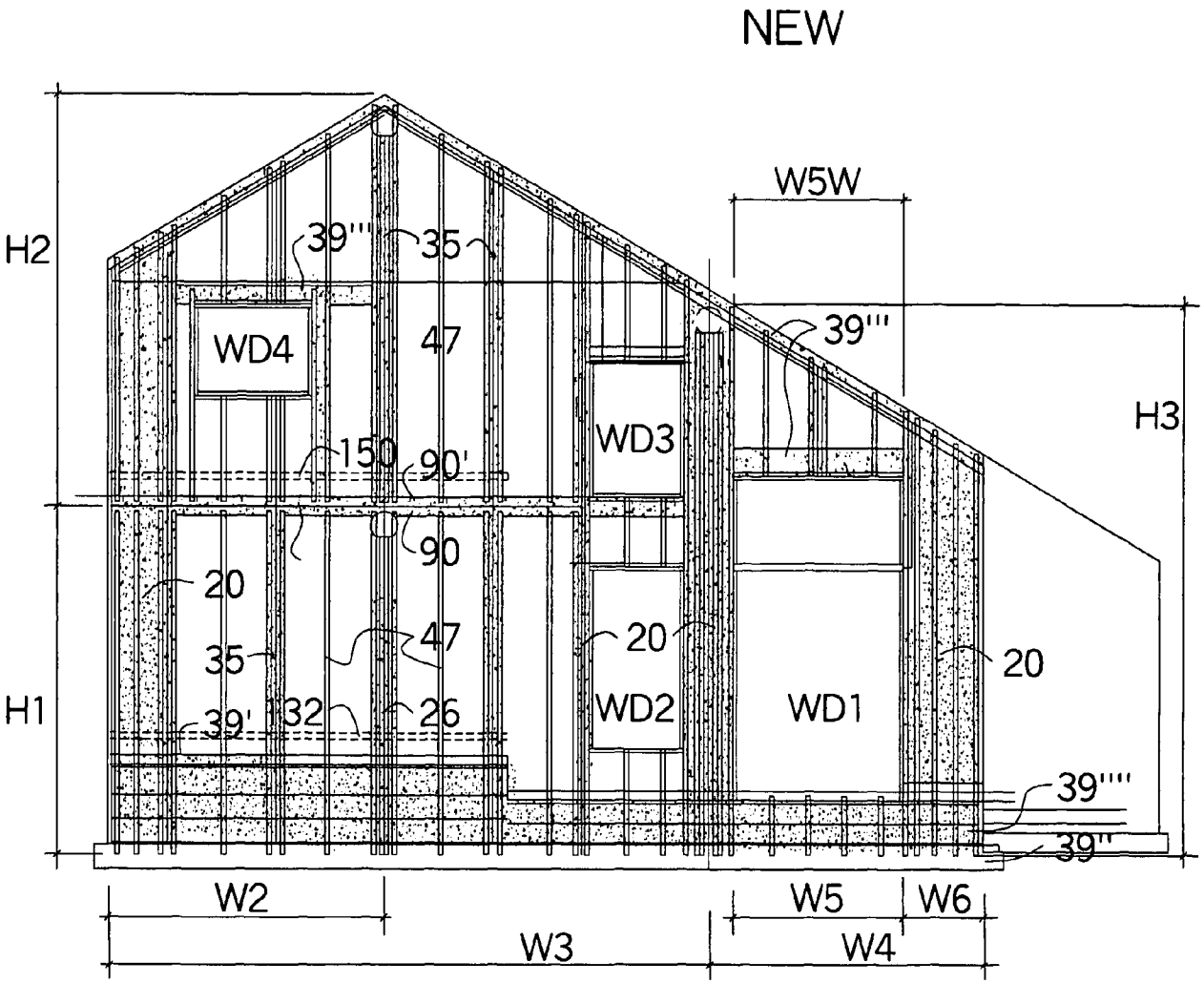
FIG. 28 shows a building elevation with various wall panels including concrete beam and wall molds configurations with intermediate spacer channels between the column molds, corner L shaped column molds at the corners of the wall forming structure.

FIG. 28 shows a panel diagram of a building elevation using many of the previously described column and beam molds as well as the wall panels. When constructing a building using wall panels, each wall panel requires a different number even though the wall panels are a variation of the previously described wall panels 65. The wall panels shown in this drawing can be as narrow as 4'-0" wide shown as W1 to intermediate panel widths shown as W2 to full width walls shown as W3. The height H1 of any of the W1, W2 or W3 wall panels could be from the footing 39", including the concrete foundation 39"" to the beam mold 90 at the second floor. Wall panels are sometimes manufactured from column centerlines or from large window jambs depending on the size of the windows. The wall panel W4 is shown in the middle of column mold 20 to the end of the wall panel W6 and extending from the footing 39", including the foundation 39'" to the roof referring to height H3. On the other hand, smaller sections like a foundation wall panel W5 is easier to handle without using a crane (not shown) to install the foundation wall panel W5. Another example would be wall panel W6 as part of an L column mold 20 or a window header mold W5W which incorporated a concrete beam 39'" at the roof line as well as above the door/window WD1. The interlocking panel connection shown in FIGS. 1, 2 & 21 are shown at the beam molds 90. On the other hand, the wall panel W2 could be two stories high by making the panel heights H1 and H2 as all one panel height. This particular building showed the concrete columns 35 close together, therefore there are not many spacer channels 47. The column mold 20 is shown wider as it depends on the spacing between window/door WD1 & WD2 as well as any floor or roof beams that would affect the size of the column mold 20. For example, the column mold 20 is shown in FIG. 6 as an L shape is used on the right side of the building along with the window detail shown in the same drawing. Another column mold 20 is shown on the left corner of the building that is also L shaped, however the size and number of column support members is less than on the right side. A column mold 20 is shown next to a window WD2 and is a wider column mold. Since a concrete beam 39'" is located between the building floors above, a window header like a concrete beam 39'" is not required.

Figure 29:
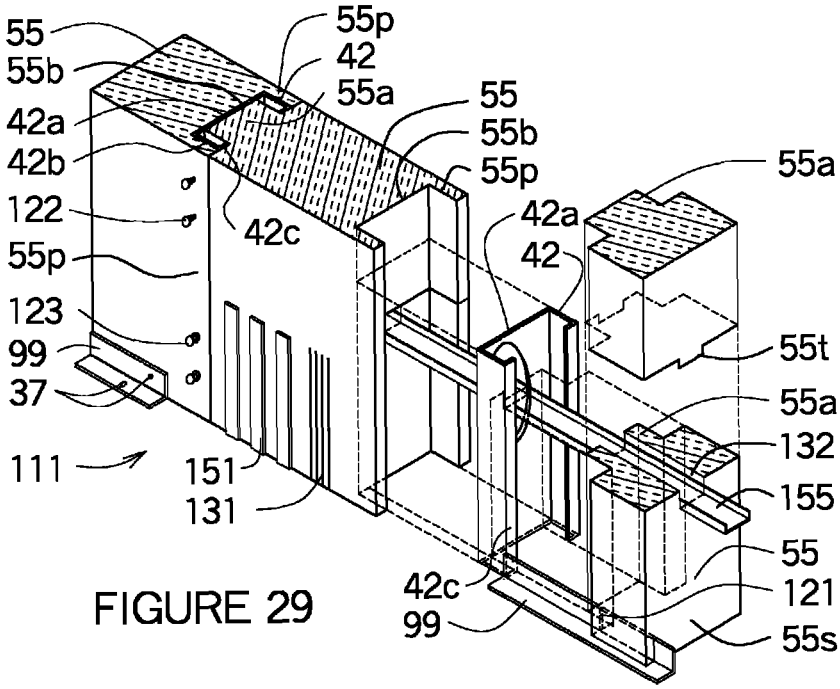
FIG. 29 shows a isometric view the tongue and groove assembly at the structural insulation core.
Figure 30:
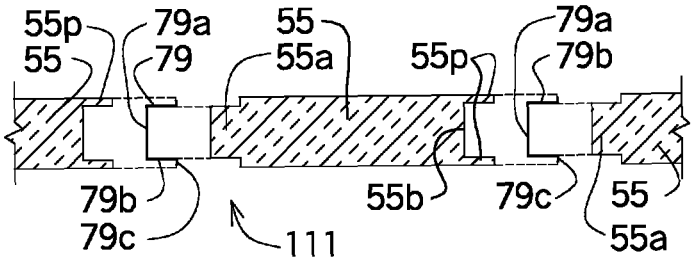
FIG. 30 shows a plan view with the tongue and groove assembly using the reverse lip channel at the structural insulating core.
Figure 31:
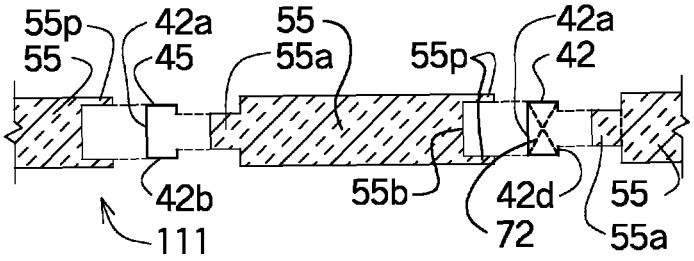
FIG. 31 show a plan view with the tongue and groove assembly using the C channel at the structural insulating core.
Figure 36:
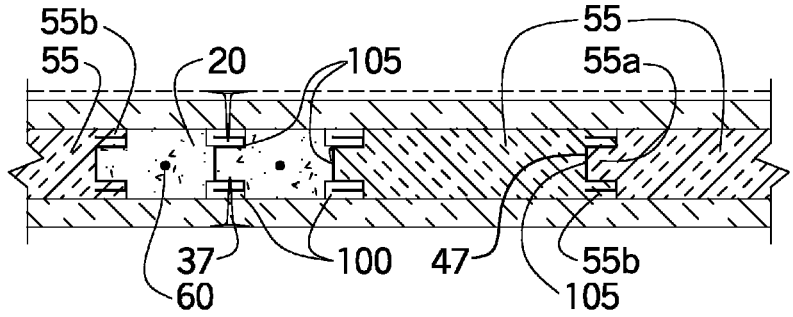
FIG. 36 shows a plan view of the double flange channel in the wall.

FIG. 29 shows an isometric drawing of the structural insulating core 111 without the rigid board and rigid insulation as previous shown, but with C channels 42 and foam spacers 55 that are wider than the C channels 42. The foam spacer 55 between the C channels 42 abuts the web 42*a* at the tongue shape 55*a* of the foam spacer 55 and the foam spacer 55 abuts the lip 42*c* at the C channel 42 on the left. The opposite end of the foam spacer 55 has the groove shape 55*b* where the web 42*a* of the C channel 42 fits into. Since the foam spacers 55 are wider than the C channels 42 the excess foam spacer on both sides of the C channel 42 forms a projection 55*p* that overlaps both flanges 42*b*. The tongue and groove configuration shows how the foam spacers 55 can easily fit together between the C channels 42. The projections 55*p* of the foam spacers 55 can easily be screwed or glued to the C channels 42. The webs 42*a* can easily be glued to the foam spacers 55 creating a stronger structural insulating core 111. FIG. 1 shows the foam spacers 55 and C channels 42 in a separated position prior to securing the foam spacers 55 together creating a structural insulating core 111. In FIG. 31 the C channel 42 can be wood blocking 72, however the tongue space 55*a* is not required in the foam spacer 55. The structural insulating core 111 can be used as an independent wall; an interior core for of the columns and beam molds previously described. A screw 122 and double headed fastener 123 are shown secured through the foam spacer 55 at the projection 55*p* or into the insulating foam 100 to connect precast concrete walls to the structural insulating core 111 as shown in FIG. 36. Attaching the screw 122 and/or the double headed fastener 123 to the structural insulating core 111 provides as thermal break with the C channels 42 as well as providing a means of securing a structural insulating core 111 to the concrete facing of a precast concrete wall (not shown in this application). Also shown are drainage channels 151 that protrude from the structural insulating core 111 to create an air space should it be required when some exterior surface finish materials (not shown) are applied over the structural insulating core 111. In addition a recessed groove 133 is shown on the exterior face of the structural insulating core 111 to allow water drainage between the structural insulating core 111 and various stucco applications. Since the structural insulating core 111 is a solid wall, two methods are shown to secure the structural insulating core 111 to a floor 175. Base plate angle 99 is shown attached to the C channel 42 at the flange 42*b* and the floor 175; however a groove 121 is cut into the structural insulating core 111 at the base plate angle 99. Another method is to install the base plate angle 99 on the surface of the structural insulating core 111 and connect to the flange 42*b* of the C channel 42 using a fastener 37 and thereby having a thermal break between the C channel 42 and the base plate angle 99. A trough 132 is shown in the middle of the structural insulating core 111 and is aligned with the holes 36 of the C channel 42 for use as an electrical chase within the structural insulating core 111. In some cases the trough 132 is required to be metal channel (not shown) for compliance with some electrical codes. In addition, the trough 132 can be used to install a horizontal bracing channel and shown as a horizontal U channel 155 connecting the C channels 42 within the structural insulating core 111. Usually the holes 36 within the C channels 42 are spaced 24" apart so the trough 132 could be installed to align with the holes 36 therefore making the foam spacers 55 be shorter pieces rather than the full height of the wall. The horizontal U channel 155 is shown within the trough 132 passing through the holes 36 within the C channels 42 and into the adjoining foam spacers 55. The C channels 42 and the horizontal U channel 155 can also be shorter in length and used as brackets to secure four adjacent foam spacers 55 together. The foam spacers 55 or a smaller foam spacers 55*s* which are shown with a tongue 55*t* that fits into the trough 132 in the foam spacers 55. When the four small foam spacers 55*s* intersect the tongues 55*t* of two small foam spacers 55*s* fit into the troughs 132 of the two small foam spacers 55*s* below; plus the horizontal bracing channel connects the two small foam spacers 55*s* together as well as the C channel 42 because the horizontal U channel 155 has a hole 36 in the web 42*a* locking the C channel 42 with the tongue shape 55*a* and the groove shape 55*b* together. The smaller foam spacers 55*s* can be installed together without support channels since the tongue shapes 55*a* and the groove shapes 55*b* interlock between smaller foam spacers 55*s* as well as the horizontal bracing U channel 155 within the troughs 132 plus the tongues 55*t* fitting into the troughs 132 together form a structural insulating foam core wall.

Figure 32:
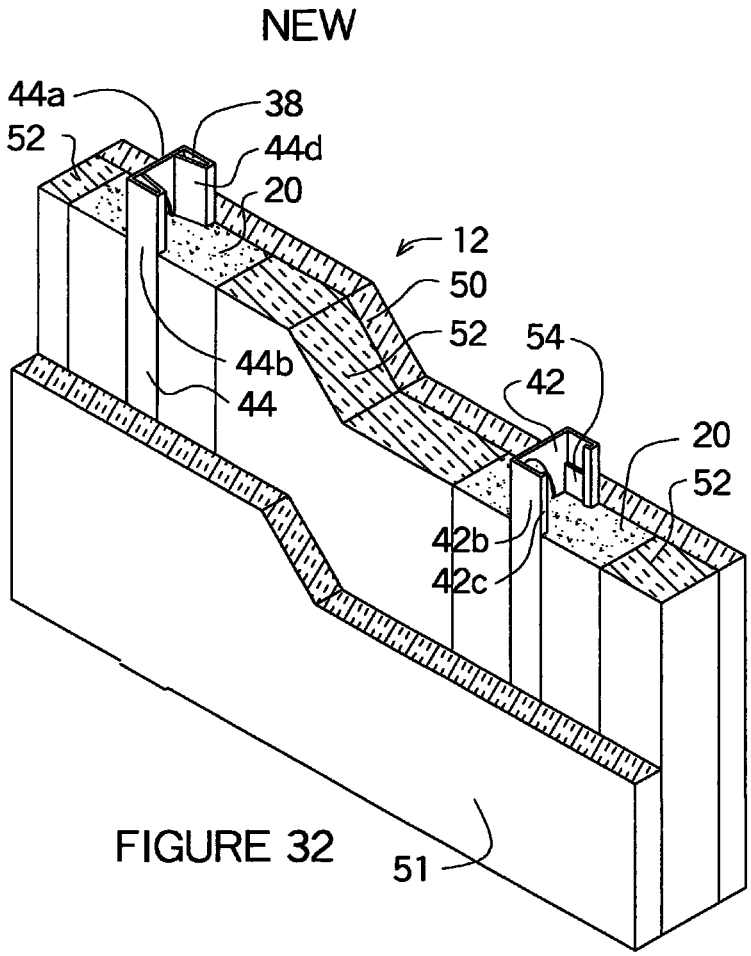
FIG. 32 is an isometric view of two columns one using a bent flange channel at the support channel of the column mold and the other column a C channel.
Figure 33:
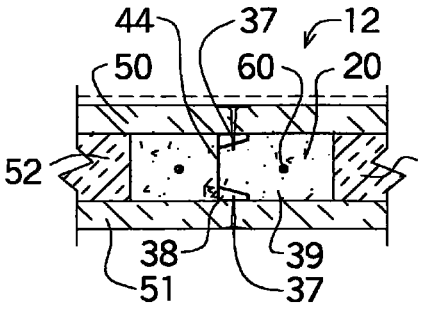
FIG. 33 is a plan view showing the bent flange channel at the center of the column forming structure.
Figure 34:
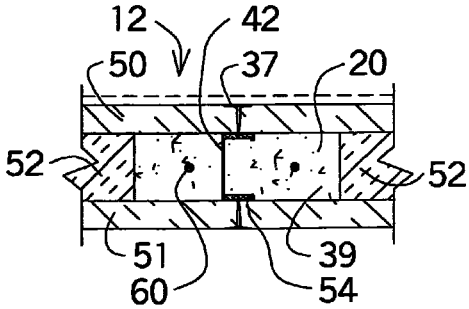
FIG. 34 is a plan view showing a C channels with insulation material at the flange.

In FIGS. 32-34 a wall mold 12 is shown in isometric view with two column molds 20. The wall mold 12 consists of a rigid board 50 and rigid insulation 51 as the outer surfaces of wall mold 12 along with the spacer insulation 52 between the outer surfaces. The distance between the spacer insulations 52 define the width of column mold 20. The plan view in FIG. 33 shows a bent flange channel 44 as the column forming structure and is located in the middle of column mold 20. The bent flange channel 44 has a web 44*a* which is the same width as the spacer insulation 52. The bent flanges consist of two parts, that is, 44*b* is adjacent to the rigid insulation 51 and the remainder of the bent flange 44*d* is bent again to be close to the web 44*a*. The double bending of flange 44*b* & 44*d* allows a fastener 37 to secure the bent flange channel 44 at two spots that is the flange 44*b* and 44*d*. Light gauge metal say 25 gauge is not very strong, and the double flanges 44*b* and 44*d* allow two surfaces into which a fastener 37 can attach to and thereby increasing the strength a fastener 37 can attached to support the rigid board 50 as well as resist the force of wet concrete 39 pushing against the rigid board 50. When the wall mold 12 is erected vertically the steel reinforcing 60 is added and the column mold 20 is filled with concrete 39. Upon doing so the web 44*a* and the bent flanges 44*b* & 44*d* create a cavity 38. Since the cavity 38 is not filled with concrete 39 as typically the small space between the web 44*a* and the bent flange 44*d* is not large enough to allow concrete 39 to flow into. When additional materials shown (in ghost) is applied to the rigid board 50, the fastener (not shown) can then penetrate the rigid board 50 and into the bent flange channel 44 without having to penetrate into the concrete 39 within the column mold 20. In FIG. 34 another column mold 20 (shown in plan view) is formed the same as in FIG. 33, however a support channel shown as C channel 42 is the column forming structure and is located in the middle of the column mold 20. The two flanges 42*b* of the C channel 42 abut the rigid board 50 and the rigid insulation 51. The flanges 42*b* each have a lip 42*c* which is at a right angle to each of the flanges 42*b*. Between the lip 42*c* and the web 42*a* and adjacent to the flanges 42*b* a foam material 54 can be installed using several methods which is also more clearly shown in FIG. 20. When the wall mold 12 is oriented vertically, concrete 39 is installed within the column mold 20 and the foam material 54 becomes encased in the concrete 39. After the concrete 39 has cured within the column mold 20, fasteners 37 can be installed through the C channel 42 and into the foam material 54 without touching the concrete 39.

Figure 35:
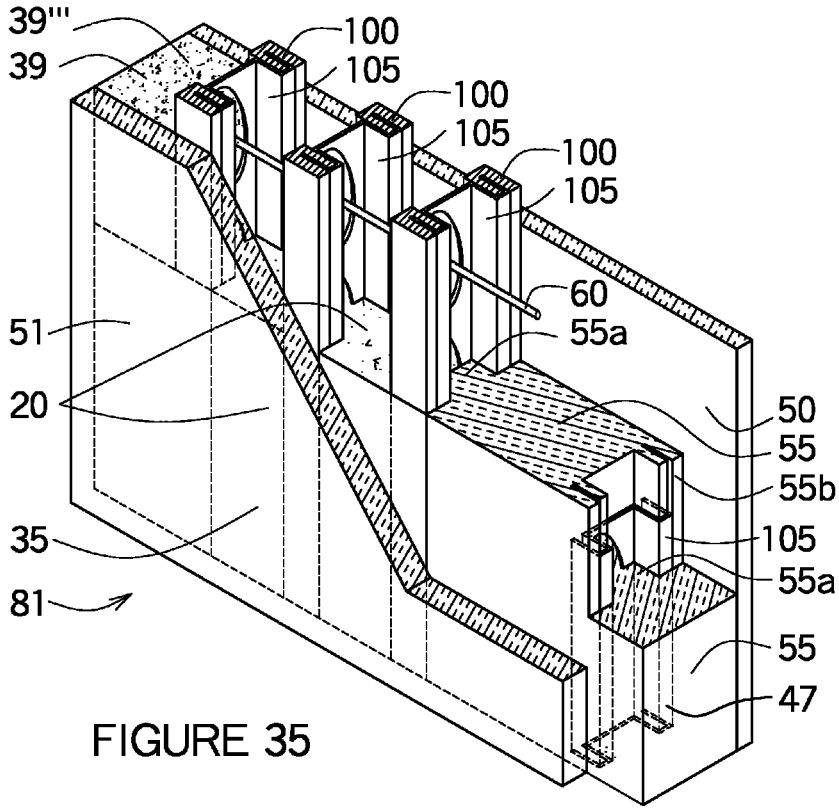
FIG. 35 shows an isometric drawing of the double flange channel with the column and beam in wall.

FIGS. 35-37 shows a wall mold 81 using a structural insulating core consisting of foam spacers 55 and support channels between the foam spacers 55 with rigid board 50 and rigid insulation 51 installed over the structural insulating core. The foam spacers 55 wrap around the flanges 105*b*' & 105*b*''' of the support channels and the webs 105*a* interlock between adjacent foam spacers 55. In addition, the flanges 105*b*' of the support channels fit into grooves shape 55*b* of foam spacer 55 and where the support channels are located within a column mold 20 or the spacer channels 47 within the foam spacers 55. More specifically the support channels of the column mold 20 forming structure is a double flange channel 105 and the interconnection between the foam spacers 55 and the insulating foam 100. FIG. 36 is showing the wall mold 81 consisting of the rigid board 50 and the rigid insulation 51 as the outer surfaces of wall mold 81. The structural insulating core forming structure at the column mold 20 consists of three double flange channels 105, however only one double flange channel 105 on the right side of the column mold 20 has the insulating foam 100. The insulating foam 100 is wrapped around the flange 105*b*' of the double flange channel 105 and the isometric shows the insulating foam 100 is also attached to the double flange channel 105 above the foam spacers 55. The insulating foam 100 is shown attached to the outer flange 105*b*'. The foam spacer 55 is configured to have a tongue shape shown as 55*a* and a groove shape shown as 55*b*. The tongue shape 55*a* extends to the web 105*a* of the double flange channel 105 and has a depth of the inner flange 105*b*'''. The width of the foam spacer 55 extends from the outer edge of the insulating foam 100 on both sides of the double flange channel 105. The other side of the foam spacer 55 shows a double flange channel 105 between the foam spacers 55. The foam spacer 55 is shown abutting the double flange channel 105 and shown as 55*b* as the groove side of the foam spacer 55. The foam spacer 55 fits adjacent to the web 105*a* of the double flange channel 105 and extends to the turning flange 105*b*'' to the edge of the projection 55*p* of the adjoining foam spacer 55. The groove shape 55*b* is configured so that the outer flange 105*b*' fits into a slot 55*s* within the projection 55*p* of the foam spacer 55. The adjacent foam spacer 55 is shown with the tongue shape 55*a* fitting securely against the web 105*a* of the double flange channel 105. Where the column mold 20 occurs, the insulating foam 100 is required the full height of a concrete column 35. On the other hand, where foam spacer 55 is required at the opposite end of the column mold 20, a groove shape 55*b* is required to begin an array of foam spacer 55 and double flange channels 105 within the wall mold 81. In FIG. 36 the double flange channel 105 is also being used as a spacer channel 47. The combination of the double flange channel 105 and the foam spacer 55 is another combination of the structural insulating core. The column molds 20 (only one shown) and beam mold 90 can be any size depending on the structural requirements of the column and beam. The wall mold 81 can consist of several wall panels between each column mold 20 and the beam mold 90 within the wall panels connects to the column molds 20. Where a beam mold 90 occurs, the insulating foam 100 is installed on the double flange channel 105.

CONCLUSION AND SCOPE OF INVENTION

A wall mold with support members and rigid insulation spacer blocks form a structural insulating core wall wherein inner and outer boards are attached to form column and beam molds into which concrete is poured into when installed vertically. Various types of connectors and support members form many different variations of the column and beam molds. Each type of connectors require different grooves within the inner and outer boards forming various type of molds. The beam molds use various types of connectors, the structural insulating core, the structural support members within the wall extending above the structural insulating core and the inner and outer boards. The column mold is also formed by the sides of the structural insulating core, connectors, support channel and flange extensions plus the inner and outer boards. Several joint shapes within the inner and outer boards are required depending on the shape of the channels, connectors or flange extensions.

It is understood that the invention is not to be limited to the exact details of operation or structures shown and describing in the specification and drawings, since obvious modifications and equivalents will be readily apparent to those skilled in the art. The flexibility of the described invention is very versatile and can be used in many different types of building applications.

The invention claimed is:

1. Connectors and wall molds for forming concrete beams and columns above and between a structural insulating core comprising:

the structural insulating core having an array of support channels and connectors extending above a height of spacer insulation blocks in the beam mold and between sides forming the column mold;

the spacer insulation blocks having inner and outer boards installed between the webs of adjacent support channels, the blocks fully supporting the beam mold and the sides of the column mold;

the inner and outer boards attached to support groove flanges, grooves for the connectors ends to be inserted into, connectors twisted into place within the grooves connecting the inner and outer faces forming the column and beam molds, connectors attached to the inner and outer boards between the support channels, support channels having foam material at the flanges, support channels having hollow flanges, support clips being shorter than support channels, support channels having embedded channel flanges within the inner and outer boards, twist connectors that rotate into place between inner and outer boards, and channel flange extensions installed in a void between the inner and outer boards of the column and beam molds.

2. The connectors and wall mold of claim 1 further comprising an "H" shaped support channels within the inner and outer boards.

3. The connectors and wall mold of claim 2 further comprising the grooves being "T" shaped.

4. The connectors and wall mold of claim 2 further comprising the "H" shaped support channels within the outer surface of the inner and outer boards.

5. The connectors and wall mold of claim 1 further comprising wherein one-half of a column mold is formed at the end of one wall mold and an adjacent one-half of a column mold are connected together to complete the column mold.

6. The connectors and wall mold of claim 5 further comprising one-half of a column mold in one panel and the adjacent one-half column mold intersect at their corners forming an "L" shaped column mold.

7. Connectors and wall molds of claim 1 further comprising column and beam molds being larger and deeper than column and beam molds within the wall molds.

8. The connectors and wall mold of claim 1 further comprising horizontal bracing channels between the horizontal trough and the horizontal tongue of the spacer blocks to pass through the column and beam molds.

9. The connectors and wall mold of claim 8 further comprising a larger horizontal bracing channel to cover the horizontal bracing channels forming a hollow space within the column and beam molds.

* * * * *